US005444648A

United States Patent [19]

Kimura

[11] Patent Number: 5,444,648

[45] Date of Patent: Aug. 22, 1995

[54] ANALOG MULTIPLIER USING QUADRITAIL CIRCUITS

[75] Inventor: Katsuji Kimura, Tokyo, Japan

[73] Assignee: NEC Corporation, Tokyo, Japan

[21] Appl. No.: 120,462

[22] Filed: Sep. 14, 1993

[30] Foreign Application Priority Data

Oct. 30, 1992 [JP] Japan ..... 4-316120
Jun. 23, 1993 [JP] Japan ..... 5-176025

[51] Int. Cl.[6] ..... G06G 7/16
[52] U.S. Cl. ..... 364/841
[58] Field of Search ..... 364/841; 307/529, 498; 328/144, 160

[56] References Cited

U.S. PATENT DOCUMENTS 4,724,337 2/1988 Maeda et al. ..... 307/262
5,107,150 4/1992 Kimura ..... 307/529
5,115,409 5/1992 Stepp ..... 364/841
5,187,682 2/1993 Kimura ..... 364/841
5,265,044 11/1993 Singh ..... 364/784

FOREIGN PATENT DOCUMENTS 3-47770 10/1986 Japan .
3-210683 9/1991 Japan .

OTHER PUBLICATIONS

Proceedings of the 1992 IEICE Fall Conference, Sep. 27-30, 1992, Tokyo, Japan.

*Primary Examiner*—Tan V. Mai
*Attorney, Agent, or Firm*—Sughrue, Mion, Zinn, Macpeak & Seas

[57] ABSTRACT

A multiplier having first and second quadritail circuits, each of which has two pairs of transistors whose capacities are the same, respectively, and is driven by a constant current source. In the first quadritail circuit, input ends of a first pair are respectively applied with voltages $\pm(V_1+V_2)$, and input ends of a second pair are connected in common to be biased by a middle point voltage of the voltage applied between the input ends of the first pair. In the second quadritail circuit, input ends of a third pair are respectively applied with voltages $\pm(V_1-V_2)$, and input ends of a fourth pair are connected in common to be biased by a middle point voltage of the voltage applied between the input ends of the third pair. Common-connected output ends of the first and fourth pairs are respectively connected in common to form one of differential output ends, and common-connected output ends of the second and third pairs are connected in common to form the other of the differential output ends. Simplification of circuit configuration and reduction of current consumption are accomplished.

18 Claims, 16 Drawing Sheets

ANALOG MULTIPLIER USING QUADRITAIL CIRCUITS

BACKGROUND OF THE INVENTION

1. Field of the Invention

The present invention relates a multiplier and more particularly, to a multiplier for analog signals using quadritail cells or circuits formed of bipolar transistors or metal-oxide-semiconductor (MOS) transistors, which is formed on semiconductor integrated circuits.

2. Description of the Prior Art

It is well known that an analog multiplier is composed of an adder 1, a first subtracter 2, a first squarer 3, a second squarer 4 and a second subtracter 5, as shown in FIG. 1. In FIG. 1, a first analog input signal (voltage $V_1$) and a second analog input signal (voltage $V_2$) are respectively applied in parallel to the adder 1 and the first subtracter 2. The adder 1 outputs a voltage $(V_1+V_2)$ which is the sum of the first and second input voltages $V_1$ and $V_2$, the first subtracter 2 outputs a voltage $(V_1-V_2)$ which is the difference thereof. The output of the adder 1 is squared in the first squarer 3 and the output of the subtracter 2 is squared in the second square 4, and then the outputs of the first and second squarer 3 and 4 are sent to the second subtracter 5. In the second subtracter 5, since an operation such as $(V_1+V_2)^2-(V_1-V_2)^2$ is carried out, an output voltage $V_0$ of $4V_1V_2$ can be obtained. This means that the circuit shown in FIG. 1 has a function of multiplying the first and second input signals.

The inventor has developed a squarer composed of two differential pair each of which has two MOS transistors different in capacity from each other. Here, the "capacity" of the MOS transistor means that a ratio of the gate width W to the gate length L, or (W/L). Besides, the inventor has filed a Japanese patent application about a multiplier as shown in FIG. 2, in which the inventor's squarer is used as the first and second squarers 2 and 3 respectively and the adder 1 and the first subtracter 2 are respectively composed of differential pairs of MOS transistors (see Japanese Non-Examined Patent Publication 3-210683 and its correslonding U.S. Pat. No. 5,107,150).

The prior art multiplier shown in FIG. 2 is composed of MOS transistors. An adder 6 is comprised of four MOS transistors M51, M52, M53 and M54 whose capacities are the same, and two constant current sources (current $I_0$) which drive the pair of the transistors M51 and M52 and that of the transistors M53 and M54, respectively. The first input voltage $V_1$ is applied between the input ends or gates of the transistors M51 and M52. The second input voltage $V_2$ is applied between the input ends or gates of the transistors M53 and M54.

A first subtracter 7 has a similar configuration to the adder 6, however, is different therefrom in input voltage. The subtracter 7 is comprised of four MOS transistors M59, M60, M61 and M62 whose capacities (W/L) are the same, and two constant current sources (current $I_0$) which drive the pair of the transistors M59 and M60 and that of the transistors M61 and M62, respectively. The first input voltage $V_1$ is applied between the input ends or gates of the transistors M59 and M60 with the same polarity as that of the transistors M51 and M52 of the adder 6. The second input voltage $V_2$ is applied between the input ends or gates of the transistors M61 and M62 with the opposite polarity as that of the transistors M53 and M54 of the adder 6.

The first squarer 8 is comprised of four MOS transistors M55, M56, M57 and M58 and two constant current sources (current $I_{01}$) which drive the pair of the transistors M55 and M56 and that of the transistors M57 and M58, respectively. The transistors M55 and M56 are different in capacity from each other and the transistors M57 and M58 are also different in capacity from each other. When the capacities of the transistors M55, M56, M57 and M58 are defined as (W55/L55), (W56/L56), (W57/L57) and (W58/L58), respectively, $$(W56/L56)/(W55/L55)=(W58/L58)/(W57/L57)=K$$

is established, where $K>1$.

The gates of the transistors M55 and M58 are connected to the drains of the transistors M52 and M54, the gates of the transistors M56 and M57 are connected to the drains of the transistors M51 and M53.

The second squarer 9 has a similar configuration to that of the first squarer 8. The second squarer 9 is comprised of four MOS transistors M63, M64, M65 and M66 and two constant current sources (current $I_{01}$) which drive the pair of the transistors M63 and M64 and that of the transistors M65 and M66, respectively. The transistors M63 and M64 are different in capacity from each other and the transistors M65 and M66 are also different in capacity from each other. Similar to the first squarer 8, the capacities (W63/L63), (W64/L64), (W65/L65) and (W66/L66) of the respective transistors M63, M64, M65 and M66 has the following relationships as $$(W64/L64)/(W63/L63)=(W66/L66)/(W65/L65)=K$$

where $K>1$.

In the second squarer 9, the gates of the transistors M63 and M66 are connected to the drains of the transistors M60 and M62 of the first subtracter 7, and the gates of the transistors M64 and M65 are connected to the drains of the transistors M63 and M65 thereof. Further, the gates of the transistors M64 and M65 are connected to the drains of the transistors M59 and M61 of the first subtracter 7, on the one hand, and connected to the drains of the transistors M56 and M58 of the first squarer 8, on the other hand.

The drains of the transistors M55 and M57 of the first squarer 8 and the drains of the transistors M66 and M64 of the second squarer 9 are connected in common to form one of output ends. The drains of the transistors M56 and M58 of the first squarer 8 and the drains of the transistors M65 and M63 of the second squarer 9 are connected in common to form the other of the output ends. These output ends thus formed are respectively connected to the input ends of the second subtracter 10.

Next, the operation principle of the prior art multiplier as above will be described below.

With the adder 6, since the four MOS transistors M51, M52, M53 and M54 are equal in capacity (W/L) to each other, they have the same transconductance parameters, respectively. Then, the transconductance parameter $\alpha_1$ is expressed as $$\alpha_1=(\tfrac{1}{2})\mu_n C_{0X}(W51/L51)$$

using the capacity (W51/L51) of the transistor M51, where $\mu_n$ is the carrier mobility, $C_{OX}$ is the gate oxide capacitance per unit area, so that the drain currents $I_{d1}$, $I_{d2}$, $I_{d3}$ and $I_{d4}$ of the respective transistors M51, M52, M53 and M54 are expressed as the following equations 1—1, 1-2, 1-3 and 1-4, respectively, where $V_{GS1}$, $V_{GS2}$, $V_{GS3}$ and $V_{GS4}$ are the gate-source voltages of the transistors M51, M52, M53 and M54, respectively, and $V_{TH}$ is the threshold voltage of these transistors.

$$I_{d1}=\alpha_1 (V_{GS1}-V_{TH})^2 \quad (1\text{—}1)$$

$$I_{d2}=\alpha_1 (V_{GS2}-V_{TH})^2 \quad (1\text{—}2)$$

$$I_{d3}=\alpha_1 (V_{GS3}-V_{TH})^2 \quad (1\text{-}3)$$

$$I_{d4}=\alpha_1 (V_{GS4}-V_{TH})^2 \quad (1\text{-}4)$$

Besides, $I_{d1}+I_{d2}=I_0$, $I_{d3}+I_{d4}=I_0$, $V_{GS1}-V_{GS2}=V_1$, $V_{GS3}-V_{GS4}=V_2$ are established, and the current differences $(I_{d1}-I_{d2})$ and $(I_{d3}-I_{d4})$ are expressed as the following equations 2 and 3, respectively, so that the differential output current $(I_A-I_B)$ can be obtained as the following equation 4.

$$I_{d1} - I_{d2} = \alpha_1 V_1 \sqrt{[(2I_0/\alpha_1) - V_1^2]} \quad (2)$$

$$I_{d3} - I_{d4} = \alpha_1 V_2 \sqrt{[(2I_0/\alpha_1) - V_2^2]} \quad (3)$$

$$\begin{aligned} I_A - I_B &= (I_{d1} + I_{d3}) - (I_{d2} + I_{d4}) \\ &= (I_{d1} - I_{d2}) + (I_{d3} - I_{d4}) \\ &= \alpha_1 V_1 \sqrt{[(2I_0/\alpha_1) - V_1^2]} + \\ &\quad \alpha_1 V_2 \sqrt{[(2I_0/\alpha_1) - V_2^2]} \end{aligned} \quad (4)$$

The equations 2 and 3 show the transfer characteristics of the differential pair of the MOS transistors. From the equations 2 and 3, it is seen that the current differences $(I_{d1}-I_{d2})$ and $(I_{d3}-I_{d4})$ are in proportion to the input voltages $V_1$ and $V_2$ in small signal applications, respectively. Therefore, from the equation 4, the differential output current $(I_A-I_B)$ has an adding characteristic with good linearity when the input voltages $V_1$ and $V_2$ are small in value.

In order to use the adder 6 as a subtracter, the second input voltage $V_2$ is required to be applied thereto with opposite polarity. Then, in the first subtracter 7, the second input voltage $V_2$ is applied thereto with such polarity.

With the first subtracter 7, the drain currents of the respective transistors M59, M60, M61 and M62 are defined as $I_{d11}$, $I_{d12}$, $I_{d13}$ and $I_{d14}$, respectively, the current differences $(I_{d11}-I_{d12})$ and $(I_{d13}-I_{d14})$ are expressed as the following equations 5 and 6, respectively, and the differential output current $(I_c-I_D)$ is expressed as the following equation 7.

$$I_{d11} - I_{d12} = \alpha_1 V_1 \sqrt{[(2I_0/\alpha_1) - V_1^2]} \quad (5)$$

$$I_{d13} - I_{d14} = -\alpha_1 V_2 \sqrt{[(2I_0/\alpha_1) - V_2^2]} \quad (6)$$

-continued $$\begin{aligned} I_C - I_D &= (I_{d11} - I_{d13}) - (I_{d12} - I_{d14}) \\ &= (I_{d11} - I_{d12}) - (I_{d13} - I_{d14}) \\ &= \alpha_1 V_1 \sqrt{[(2I_0/\alpha_1) - V_1^2]} - \\ &\quad \alpha_1 V_2 \sqrt{[(2I_0/\alpha_1) - V_2^2]} \end{aligned} \quad (7)$$

Accordingly, the differential output voltage $V_A$ of the adder 6 and the differential output voltage $V_B$ of the first subtracter 7 are expressed as the following equations 8 and 9, respectively.

$$\begin{aligned} V_A &= R_L(I_A - I_B) \\ &= R_L[\alpha_1 V_1 \sqrt{\{(2I_0/\alpha_1) - V_1^2\}} + \\ &\quad \alpha_1 V_2 \sqrt{\{(2I_0/\alpha_1) - V_2^2\}}\ ] \end{aligned} \quad (8)$$

$$\begin{aligned} V_B &= R_L(I_C - I_D) \\ &= R_L[\alpha_1 V_1 \sqrt{\{(2I_0/\alpha_1) - V_1^2\}} + \\ &\quad \alpha_1 V_2 \sqrt{\{(2I_0/\alpha_1) - V_2^2\}}\ ] \end{aligned} \quad (9)$$

With the first squarer 8, since the capacity ratios (W56/L56)/(W55/L55) and (W58/L58)/(W57/L57) of the MOS transistors M55 and M56 and the transistors M57 and M58 are K. The transconductance parameter $\alpha_2$ is expressed as $$\alpha_2=(\tfrac{1}{2})\mu_n C_{OX}(W55/L55)$$

using the capacity (W55/L55) of the transistor M55, so that the drain currents $I_{d5}$, $I_{d6}$, $I_{d7}$ and $I_{d8}$ of the respective transistors M55, M56, M57 and M58 are expressed as the following equations 10-1, 10-2, 10-3 and 10-4, respectively, where $V_{GS5}$, $V_{GS6}$, $V_{GS7}$ and $V_{GS8}$ are the gate-source voltages of the transistors M55, M56, M57 and M58, respectively, and $V_{TH}$ is the threshold voltage of these transistors.

$$I_{d5}=\alpha_2(V_{GS5}-V_{TH})^2 \quad (10\text{-}1)$$

$$I_{d6}=k\alpha_2(V_{GS6}-V_{TH})^2 \quad (10\text{-}2)$$

$$I_{d7}\alpha_2(V_{GS7}-V_{TH})^2 \quad (10\text{-}3)$$

$$I_{d8}=k\ \alpha_2(V_{GS8}-V_{1H})^2 \quad (10\text{-}4)$$

Besides, $I_{d5}+I_{d6}=I_{01}$, $I_{d7}+I_{d8}=I_{01}$, $V_{GS5}-V_{GS6}=V_{GS8}-V_{GS7}=V_A$ are established, and the current differences $(I_{d5}-I_{d6})$ and $(I_{d7}-I_{d8})$ are expressed as the following equations 11 and 12, respectively.

$$I_{d5} - I_{d6} = \frac{-\left(1-\frac{1}{k}\right)\left\{\left(1+\frac{1}{k}\right)I_{01} - 2\alpha_2 V_A^2\right\}}{\left(1+\frac{1}{k}\right)^2} + \frac{4\alpha_2 V_A \frac{1}{\sqrt{k}}\sqrt{\left(1+\frac{1}{k}\right)\frac{I_{01}}{\alpha_2} V_A^2}}{\left(1+\frac{1}{k}\right)^2} \quad (11)$$

-continued $$I_{d7} - I_{d8} = \frac{-\left(1-\frac{1}{k}\right)\left\{\left(1+\frac{1}{k}\right)I_{01} - 2\alpha_2 V_A^2\right\}}{\left(1+\frac{1}{k}\right)^2} + \frac{4\alpha_2 V_A \frac{1}{\sqrt{k}}\sqrt{\left(1+\frac{1}{k}\right)\frac{I_{01}}{\alpha_2}V_A^2}}{\left(1+\frac{1}{k}\right)^2} \quad (12)$$

Then, the differential output current ($I_E - I_F$) can be expressed as the following equation 13. From the equation 13, it is seen that the differential output current ($I_E - I_F$) is in proportion to the square of the input voltage $V_A$.

$$\begin{aligned} I_E - I_F &= (I_{d5} + I_{d7}) - (I_{d6} + I_{d8}) \\ &= (I_{d5} + I_{d6}) + (I_{d7} + I_{d8}) \\ &= \frac{2\left(1-\frac{1}{k}\right)\left\{\left(1+\frac{1}{k}\right)I_{01} - 2\alpha_2 V_A^2\right\}}{\left(1+\frac{1}{k}\right)^2} \end{aligned} \quad (13)$$

With the second squarer 9, the differential output current ($I_G - I_H$) can be expressed as the following equation 14, in the same way, where $I_{d15}$, $I_{d16}$, $I_{d17}$ and $I_{d18}$ are the drain currents of the respective transistors M63, M64, M65 and M66. From the equation 14, it is seen that the differential output current ($I_G - I_H$) is in proportion to the square of its input voltage $V_B$.

$$\begin{aligned} I_G - I_H &= (I_{d15} + I_{d17}) - (I_{d16} + I_{d18}) \\ &= (I_{d15} + I_{d16}) + (I_{d17} + I_{d18}) \\ &= \frac{2\left(1-\frac{1}{k}\right)\left\{\left(1+\frac{1}{k}\right)I_{01} - 2\alpha_2 V_B^2\right\}}{\left(1+\frac{1}{k}\right)^2} \end{aligned} \quad (14)$$

In the second subtracter 10, the differential output currents $I_z (= I_E - I_F)$ and $I_2 (= I_G - I_H)$ of the first and second squarers 9 and 10 are added with their polarity being opposite, so that the differential current ($I_1 - I_2$) is expressed as the following equation 15.

$$\begin{aligned} I_1 - I_2 &= (I_E - I_F) - (I_G - I_H) \\ &= -\frac{2\left(1-\frac{1}{k}\right)\left\{\left(1+\frac{1}{k}\right)I_{01} - 2\alpha_2 V_A^2\right\}}{\left(1+\frac{1}{k}\right)^2} + \frac{2\left(1-\frac{1}{k}\right)\left\{\left(1+\frac{1}{k}\right)I_{01} - 2\alpha_2 V_B^2\right\}}{\left(1+\frac{1}{K}\right)^2} \end{aligned} \quad (15)$$

-continued $$= \frac{4\alpha_2\left(1-\frac{1}{K}\right)}{\left(1+\frac{1}{K}\right)^2}(V_A^2 - V_B^2)$$

By substituting the equations 8 and 9 into the equation 15 to replace $V_A$ and $V_B$, the following equation 16 can be obtained.

$$I_1 - I_2 = 16R_L^2\alpha_1^2\alpha_2 V_1 V_2 \frac{\left(1-\frac{1}{k}\right)}{\left(1+\frac{1}{k}\right)^2} \times \sqrt{\frac{4I_0^2}{\alpha_1^2} - \frac{2I_0}{\alpha_1}(V_1^2 + V_2^2) + V_1^2 V_2} \quad (16)$$

Then, by ignoring the terms of $V_1^2$ and $V_2^2$ in the equation 16, the following equation 17 can be given. From the equation 17, it is seen that the circuit shown in FIG. 2 has a multiplying function.

$$I_1 - I_2 = \frac{32R_L^2 I_0 \alpha_2 V_1 V_2 \alpha_1\left(1-\frac{1}{k}\right)}{\left(1+\frac{1}{k}\right)^2} \quad (17)$$

FIG. 3 shows a result of computer simulation, which is carried out under the condition that $R_L = 5$ kΩ, $I_0 = 100$ μA, $I_{01} = 10$ μA, W51=20 μm, L51=5 μm, W55=10 μm, L55=5 μm, K=5, $C_{OX} = 320$ Å.

FIG. 3 shows the relations between the differential output current and the first input voltage $V_1$ with the second input voltage $V_2$ as a parameter, however, the same result is obtained by replacing the first input voltage $V_1$ with the second input voltage $V_2$, and vice versa.

The prior art multiplier shown in FIG. 2 is comprised of MOS transistors, however, the same multiplying operation can be obtained by using bipolar transistors in place of the MOS transistors. In the case, each squarer is composed of a differential pair of transistors whose emitter area are different from each other.

It is well known that there is the minimum unit (area) of a transistor formed on semiconductor integrated circuits in order to generate desired functions, so that it is preferable to form all transistors as the minimum unit considering its current consumption. However, with the prior art multiplier shown in FIG. 2, since each differential pair of the first and second squarers is comprised of two MOS transistors whose capacities or (W/L) are different each other, all the transistors cannot be formed as the minimum unit, and as a result, there arises a problem that current consumption of the integrated circuits is made large.

In addition, with the prior art multiplier, each differential pair is provided with a constant current source, so that four constant current sources are required in total for the first and second squarers. As a result, there arises another problem that the configuration of the integrated circuits is complex.

SUMMARY OF THE INVENTION

An object of the present invention is to provide a multiplier in which its circuit configuration can be simplified and its current consumption can be reduced.

A multiplier according to a first aspect of the present invention comprises first and second quadritail circuits. Each of the quadritail circuits has two pairs of transistors whose capacities are the same and whose output ends are connected in common, respectively, and is driven by a constant current source.

In the first quadritail circuit, input ends of a first pair of the transistors are respectively applied with voltages which are opposite in phase to each other and equal in absolute value to the sum of first and second input voltages. Input ends of a second pair of the transistors are connected in common to be applied with a middle point voltage of the voltage applied between the input ends of the first pair.

In the second quadritail circuit, input ends of a third pair of the transistors are respectively applied with voltages which are opposite in phase to each other and equal in absolute value to the difference of the first and second input voltages. Input ends of a fourth pair of the transistors are connected in common to be applied with a middle point voltage of the voltage applied between the input ends of the third pair.

The common-connected output ends of the first pair of the first quadritail circuit and the common-connected output ends of the fourth pair of the second quadritail circuit are connected in common to form one of differential output ends. Similarly, the common-connected output ends of the second pair of the first quadritail circuit and the common-connected output end of the third pair of the second quadritail circuit are connected in common to form the other of the differential output ends. An output signal showing a result of multiplication is derived from the differential output ends thus formed.

A multiplier according to a second aspect of the present invention also comprises first and second quadritail circuits, similar to the multiplier according to the first aspect, and the connections of their first to fourth pairs of the transistors are the same as that of the first aspect. However, input voltages to the first and second quadritail circuits are different from those of the first aspect.

In the multiplier according to the second aspect, input ends of the first pair of the transistors of the first quadritail circuit are respectively applied with first and second input voltages. One input end of the third pair of the second quadritail circuit is applied with the first input voltage with the same phase or polarity as that of the first quadritail circuit. The other input end of the third pair are applied with the second input voltage with the opposite phase or polarity to the first quadritail circuit.

A multiplier according to a third aspect of the present invention comprises first, second and third quadritail circuits. Each of the quadritail circuits has two pairs of transistors whose output ends are connected in common, respectively, and is driven by a constant current source.

In the first quadritail circuit, a first input voltage is applied between input ends of a first pair of the transistors, and input ends of a second pair of the transistors are connected in common to be applied with a middle point voltage of the voltage applied between the input ends of the first pair.

In the second quadritail circuit, a second input voltage is applied between input ends of a third pair of the transistors, and input ends of a fourth pair of the transistors are connected in common to be applied with a middle point voltage of the voltage applied between the input ends of the third pair.

In the third quadritail circuit, the difference of the first and second input voltages is applied between input ends of a fifth pair of the transistors, and input ends of a sixth pair of the transistors are connected in common to be applied with a middle point voltage of the voltage applied between the input ends of the fifth pair.

The common-connected output ends of the first pair of the first quadritail circuit, the common-connected output ends of the third pair of the second quadritail circuit and the common-connected output ends of the sixth pair of the third quadritail circuit are connected in common to form one of differential output ends. Similarly, the common-connected output ends of the second pair of the first quadritail circuit, the common-connected output ends of the fourth pair of the second quadritail circuit and the common-connected output ends of the fifth pair of the third quadritail circuit are connected in common to form the other of the differential output ends. An output signal showing a result of multiplication is derived from the differential output ends thus formed.

In the multiplier according to the first to third aspects of the present invention, bipolar transistors or MOS transistors may be used. In case of the bipolar transistors being used, preferably, the four transistors constituting each of the quadritail circuits have diodes or resistors at their emitters, respectively.

With the multipliers of the first and second aspects of the present invention, each of the first and second quadritail circuits contains four transistors whose capacities are the same and one constant current source to obtain the square-law characteristic accurately or approximately. As a result, the number of current sources required is reduced by half compared with the prior art multiplier, so that the circuit configuration can be simplified.

In addition, since the transistors with the same capacities are used, all of the transistors can be made as the minimum unit, and as a result, the current consumption can be largely reduced.

With the multiplier of the third aspects of the present invention, the same configuration is employed as those of the first and second aspects excepting that the first to third quadritail circuits are provided, so that the same effects of advantages are obtained as those of the first and second aspects.

DETAILED DESCRIPTION OF THE PREFERRED EMBODIMENTS

Preferred embodiments of the present invention will be described below referring to FIGS. 4 to 20.

As described above, in the prior art multiplier shown in FIG. 2 which was developed by the inventor, each of the first and second squarers is comprised of two pairs of the MOS transistors whose capacities or (W/L) ratios are different from each other, and is required for two constant current sources. Accordingly, it is desirable that the squarer is comprised of MOS or bipolar transistors whose capacities are the same and a single constant current source for driving these transistors. An example of a circuit having such configuration was disclosed in the Japanese Examined Patent Publication 3-47770 and its corresponding U.S. Pat. No. 4,724,337, which is a full-wave rectifier composed of bipolar transistors. An operation of a full-wave rectifier can be roughly approximated to that of a squarer, in general.

Figure 4:
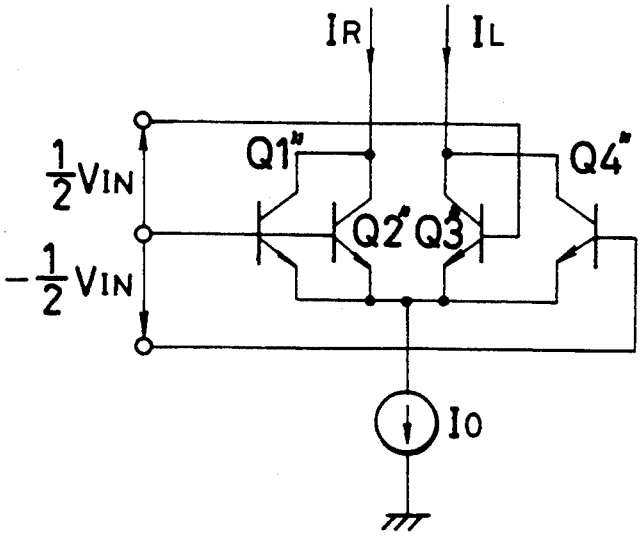
FIG. 4 PRIOR ART
FIG. 4 is a circuit diagram of a quadritail circuit composed of bipolar transistors.

FIG. 4 shows the full-wave rectifier disclosed by the Japanese Examined Patent Publication 3-47770, in which four bipolar transistors Q1", Q2", Q3" and Q4" having the same capacities are provided. The emitters of the transistors Q1", Q2", Q3" and Q4" are connected in common to a constant current source (current $I_0$) for driving them. The bases of the transistors Q1" and Q2" are connected in common. A first input voltage $(\frac{1}{2})V_{IN}$ is applied between the common-connected bases of the transistors Q1" and Q2" and the base of the transistor Q3". A second input voltage $-(\frac{1}{2})V_{IN}$ is applied between the common-connected bases of the transistors Q1" and Q2" and the base of the transistor Q4". The collectors of the transistors Q1" and Q2" are connected in common to form one of output ends, and the collectors of the transistors Q3" and Q4" are connected in common to form the other of the output ends.

With the circuit shown in FIG. 4, since the bases of the transistors Q1" and Q2" are biased by a common direct current (DC) voltage, the collector currents $I_{C1}$ and $I_{C2}$ of the respective transistors Q1" and Q2" can be expressed as the following equation 18.

$$I_{C1}=I_{C2}=I_S \exp(V_{BE}/V_T) \tag{18}$$

where $I_S$ is the saturation current, $V_{BE}$ is the base-emitter voltage of the transistor Q1" and Q2" and $V_T$ is the thermal voltage. The thermal voltage $V_T$ is expressed as $V_T=kT/q$ where k is Boltzmann's constant, T is the absolute temperature in degrees Kelvin and q is the charge of an electron.

Since the bases of the transistors Q3" and Q4" are respectively applied with the voltages $+(\frac{1}{2})V_{IN}$ and $-(\frac{1}{2})V_{IN}$ with the common-connected bases of the transistors Q1" and Q2" as a reference, the collector currents $I_{C3}$ and $I_{C4}$ of the respective transistors Q3" and Q4" can be expressed as the following equations 19-1 and 19-2.

$$I_{C3}=I_S \exp[(V_{BE}+V_{IN}/2)/V_T] \tag{19-1}$$

$$I_{C4}=I_S \exp[(V_{BE}-V_{IN}/2)/V_T] \tag{19-2}$$

Besides, currents $I_E$ and $I_L$ are defined as $I_{C1}+I_{C2}=I_E$, $I_{C3}+I_{C4}=I_L$ and $I_E+I_L=\alpha_F I_O$ is established, where $\alpha_F$ is the DC common-base current gain factor. Then, the currents $I_R$ and $I_L$ are expressed as the following equations 20 and 21, respectively.

$$I_R = \frac{\alpha_F I_0}{2\cosh^2\left(\frac{V_{IN}}{4V_T}\right)} \tag{20}$$

$$I_L = \alpha_F I_0 \left[1 - \frac{1}{2\cosh^2\left(\frac{V_{IN}}{4V_T}\right)}\right] \tag{21}$$

Figure 5:
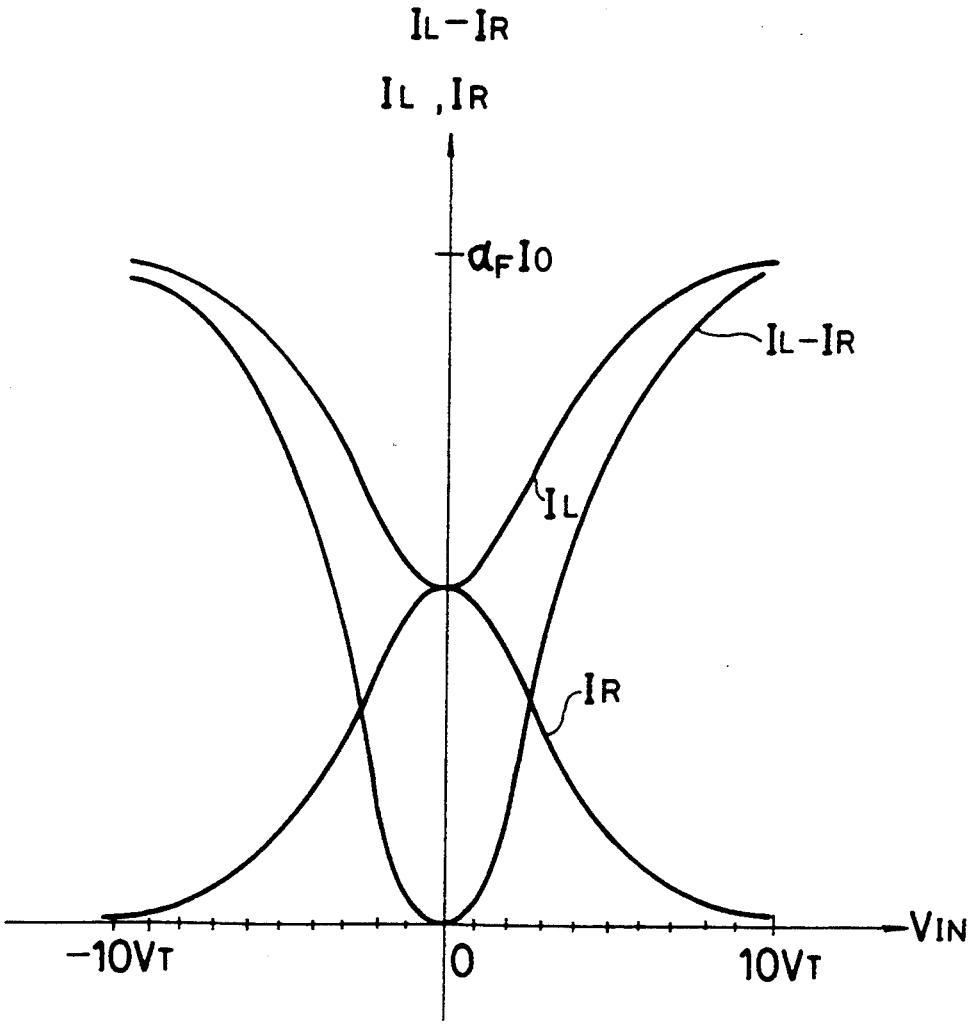
FIG. 5 is a diagram showing input-output characteristics of the quadritail circuit shown in FIG. 4.

FIG. 5 shows the curves of the currents $I_E$ and $I_L$ and their differential current $(I_L-I_E)$. From FIG. 5, it is seen that if the voltage $V_{IN}$ is limited is value, or if the absolute value of the voltage $V_{IN}$ is about 3 $V_T$ or less, the square-law characteristic is approximately obtained. This means that the circuit shown in FIG. 4 can be used as a squarer for a multiplier.

Therefore, in the present invention, a circuit having such a configuration as shown in FIG. 4 is called as a "quadritail circuit", and a multiplier is obtained by using two of the quadritail circuits. The quadritail circuit may be composed of bipolar transistors or MOS transistors.

First Embodiment

First, a multiplier composed of two bipolar quadritail circuits is described below.

Figure 6:
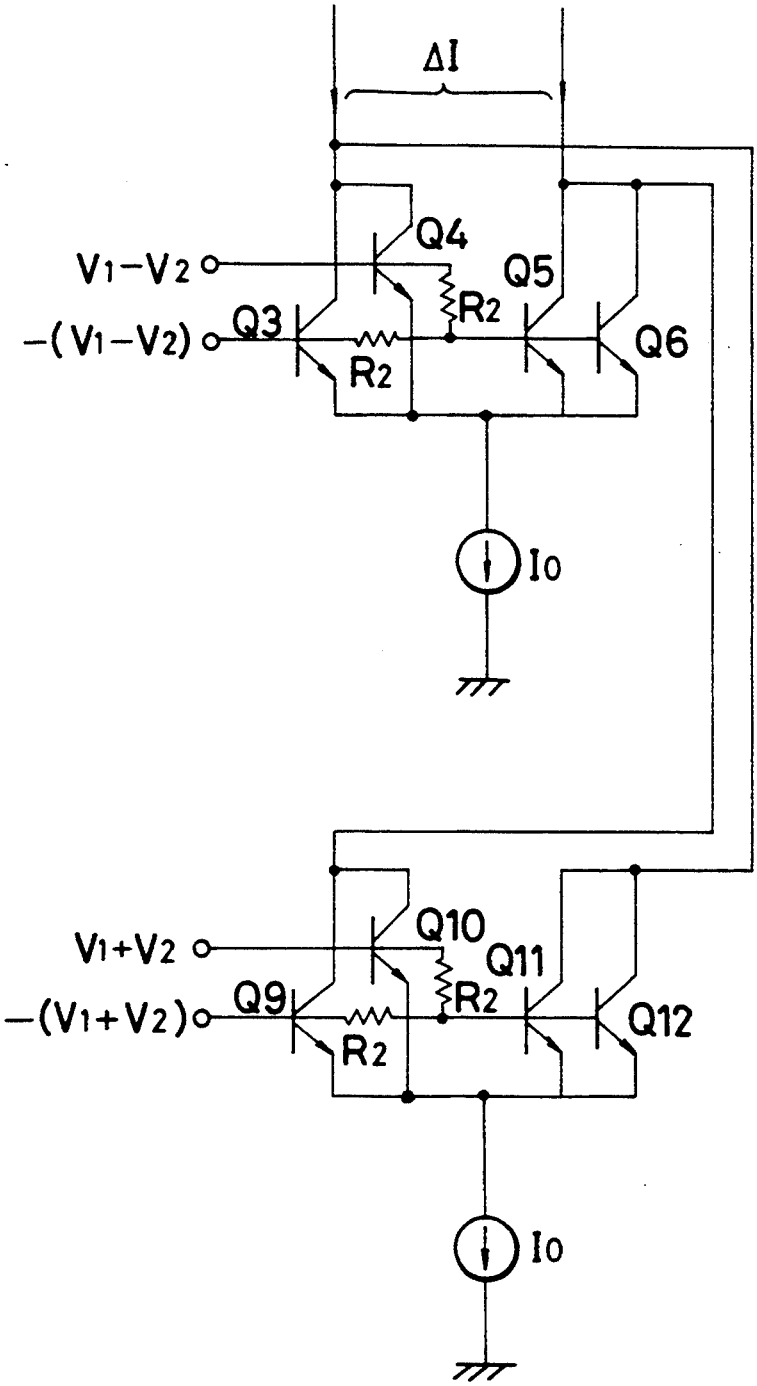
FIG. 6 is a circuit diagram of a multiplier according to a first embodiment of the present invention.

FIG. 6 shows a multiplier according to a first embodiment of the present invention. In this multiplier, two voltages of $+(V_1+V_2)$ and $-(V_1+V_2)$ which are opposite in phase to each other and equal in absolute value to the sum of a first input voltage $V_1$ and a second input voltage $V_2$, which are to be multiplied, and two voltages of $+(V_1-V_2)$ and $-(V_1-V_2)$ which are opposite in phase to each other and equal in absolute value to the difference of the first input voltage $V_1$ and the second input voltage $V_2$. Any circuit can be used to obtain these voltages $\pm(V_1+V_2)$ and $\pm(V_1-V_2)$, for example, an adder and a subtracter having the same configurations as those of the adder 6 and the first subtracter 7 as shown in FIG. 2 may be used.

Figure 2:
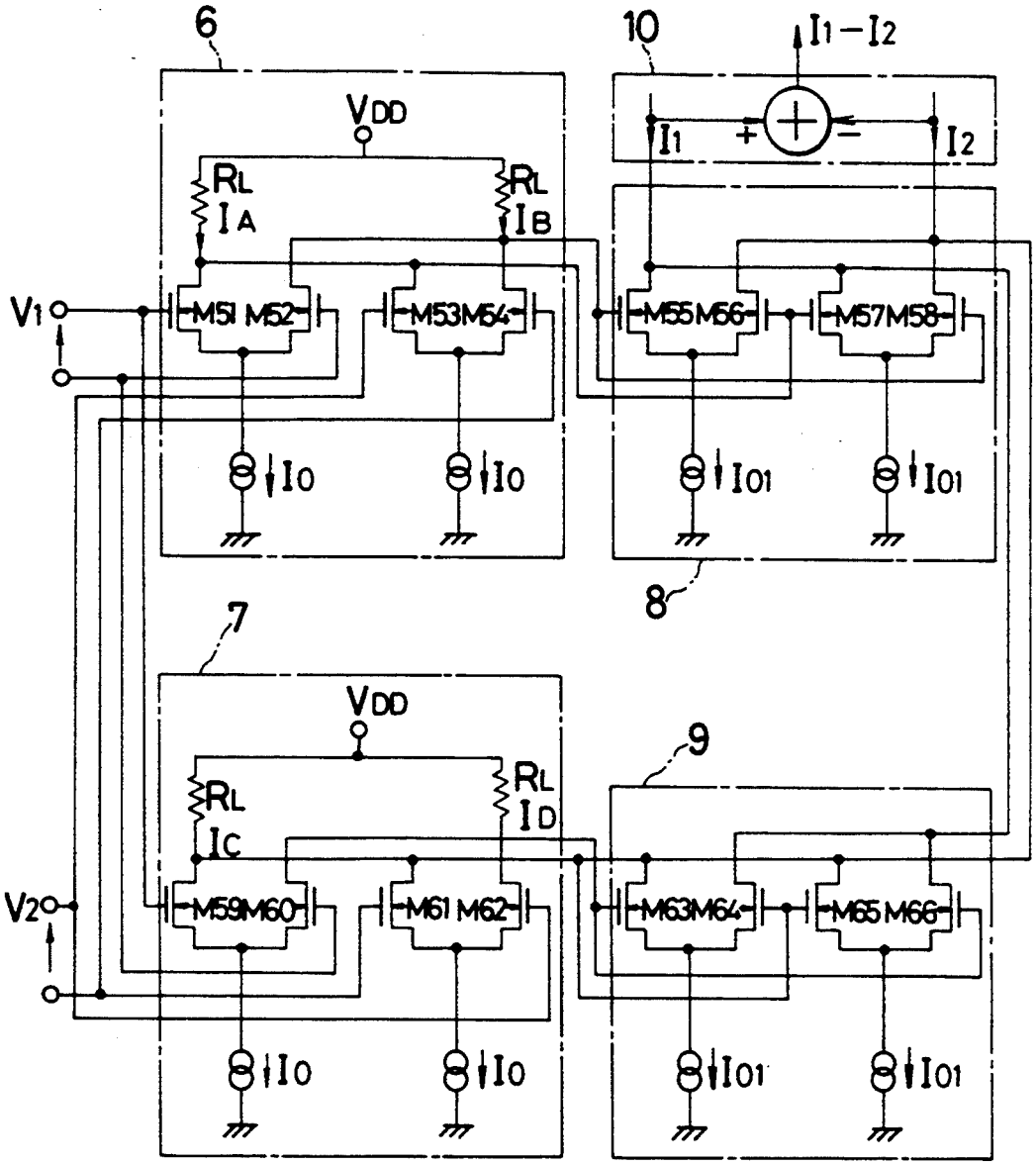
FIG. 2 PRIOR ART
FIG. 2 is a circuit diagram showing a prior art multiplier.
Figure 3:
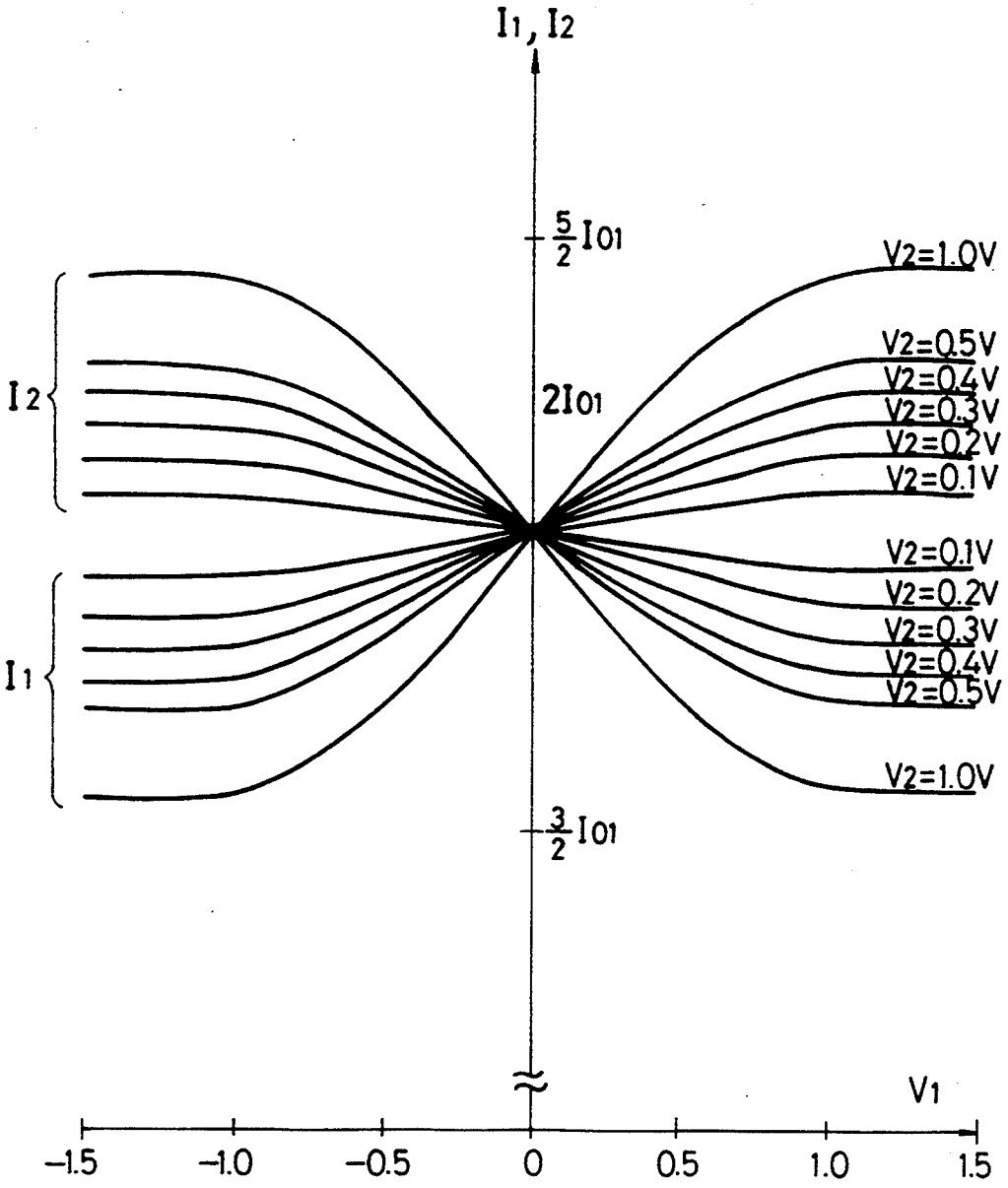
FIG. 3 PRIOR ART
FIG. 3 is a graph showing input-output characteristics of a squarer used in the prior art multiplier.

In FIG. 6, a second quadritail circuit on the upper side, which is composed of bipolar transistors Q3, Q4, Q5 and Q6 and a constant current source (current $I_0$), has a function corresponding to that of the second squarer 9 shown in FIG. 2. A first quadritail circuit on the lower side, which is composed of bipolar transistors Q9, Q10, Q11 and Q12 and a constant current source (current $I_0$), has a function corresponding to that of the first squarer 8 shown in FIG. 2.

In the second quadritail circuit, the collectors of the transistors Q3 and Q4 are connected in common. The base of the transistor Q4 is applied with the voltage $(V_1-V_2)$ and the base of the transistor Q3 is applied with the voltage $-(V_1-V_2)$ opposite in phase to the voltage $(V_1-V_2)$. The collectors of the transistors Q5 and Q6 are connected in common to the base of the transistor Q3 through a resistor (resistance $R_2$), on the one hand, and to the base of the transistor Q4 through a resistor (resistance $R_2$), on the other hand; and as a result, the common-connected bases of the transistor Q5 and Q6 are applied with a DC bias voltage, respectively. This DC bias voltage is equal to the voltage at a middle point of the voltage applied between the bases of the transistors Q3 and Q4.

The emitters of the transistors Q3, Q4, Q5 and Q6 are connected in common to the current source for driving them.

Similarly, in the first quadritail circuit, the collectors of the transistors Q9 and Q10 are connected in common. The base of the transistor Q10 is applied with the voltage $(V_1+V_2)$ and the base of the transistor Q9 is applied with the voltage $-(V_1+V_2)$ opposite in phase to the voltage $(V_1+V_2)$. The collectors of the transistors Q11 and Q12 are connected in common to the base of the transistor Q9 through a resistor (resistance $R_2$), on the one hand, and to the base of the transistor Q10 through a resistor (resistance $R_2$), on the other hand; and as a result, the common-connected bases of the transistor Q11 and Q12 are applied with a DC bias voltage, respectively. This DC bias voltage is also equal to the voltage at a middle point of the voltage applied between the bases of the transistors Q9 and Q10.

The emitters of the transistors Q9, Q10, Q11 and Q12 are connected in common to the current source for driving them.

Between the first and second quadritail circuits, the collectors of the transistors Q3 and Q4 and the collectors of the transistors Q11 and Q12 are connected in common to form one of differential output ends. The collectors of the transistors Q5 and Q6 and the collectors of the transistors Q9 and Q10 are connected in common to form the other of the differential output ends.

Here, collector currents of the transistors Q3, Q4, Q5 and Q6 are defined as $I_{C3}$, $I_{C4}$, $I_{C5}$ and $I_{C6}$, and collector currents of the transistors Q9, Q10, Q1 and Q12 are defined as $I_{C9}$, $I_{C10}$, $I_{C11}$ and $I_{C12}$, respectively. Then, the sum $(I_{C3}+I_{C4})$ of the currents $I_{C3}$ and $I_{C4}$, the sum $(I_{C5}+I_{C6})$ of the currents $I_{C5}$ and $I_{C6}$, the sum $(I_{C9}+I_{C10})$ of the currents $I_{C9}$ and $I_{C10}$ and the sum $(I_{C11}+I_{C12})$ of the currents of $I_{C11}$ and $I_{C12}$ are expressed as the following equations 22, 23, 24 and 25, respectively.

$$I_{C3}+I_{C4}=\alpha_F I_0\left[1-\frac{1}{2\cosh^2\left(\frac{V_1-V_2}{2V_T}\right)}\right] \tag{22}$$

$$I_{C5}+I_{C6}=\frac{\alpha_F I_0}{2\cosh^2\left(\frac{V_1-V_2}{2V_T}\right)} \tag{23}$$

$$C_{C9}+I_{C10}=\alpha_F I_0\left[1-\frac{1}{2\cosh^2\left(\frac{V_1+V_2}{2V_T}\right)}\right] \tag{24}$$

$$I_{C11}+I_{C12}=\frac{\alpha_F I_0}{2\cosh^2\left(\frac{V_1+V_2}{2V_T}\right)} \tag{25}$$

As a result, the differential output current $\Delta I$ $\{=(I_{C3}+I_{C4}+I_{C11}+I_{C12})-(I_{C5}+I_{C6}+I_{C9}+I_{C10})\}$ of the multiplier can be expressed as the following equation 26.

$$\begin{aligned}\Delta I &= (I_{C3}+I_{C4}+I_{C11}+I_{C12})-(I_{C5}+I_{C6}+I_{C9}+I_{C10})\\ &=\frac{\alpha_F I_0}{\cosh^2\left(\frac{V_1+V_2}{2V_T}\right)}-\frac{\alpha_F I_0}{\cosh^2\left(\frac{V_1-V_2}{2V_T}\right)}\end{aligned} \tag{26}$$

Figure 7:
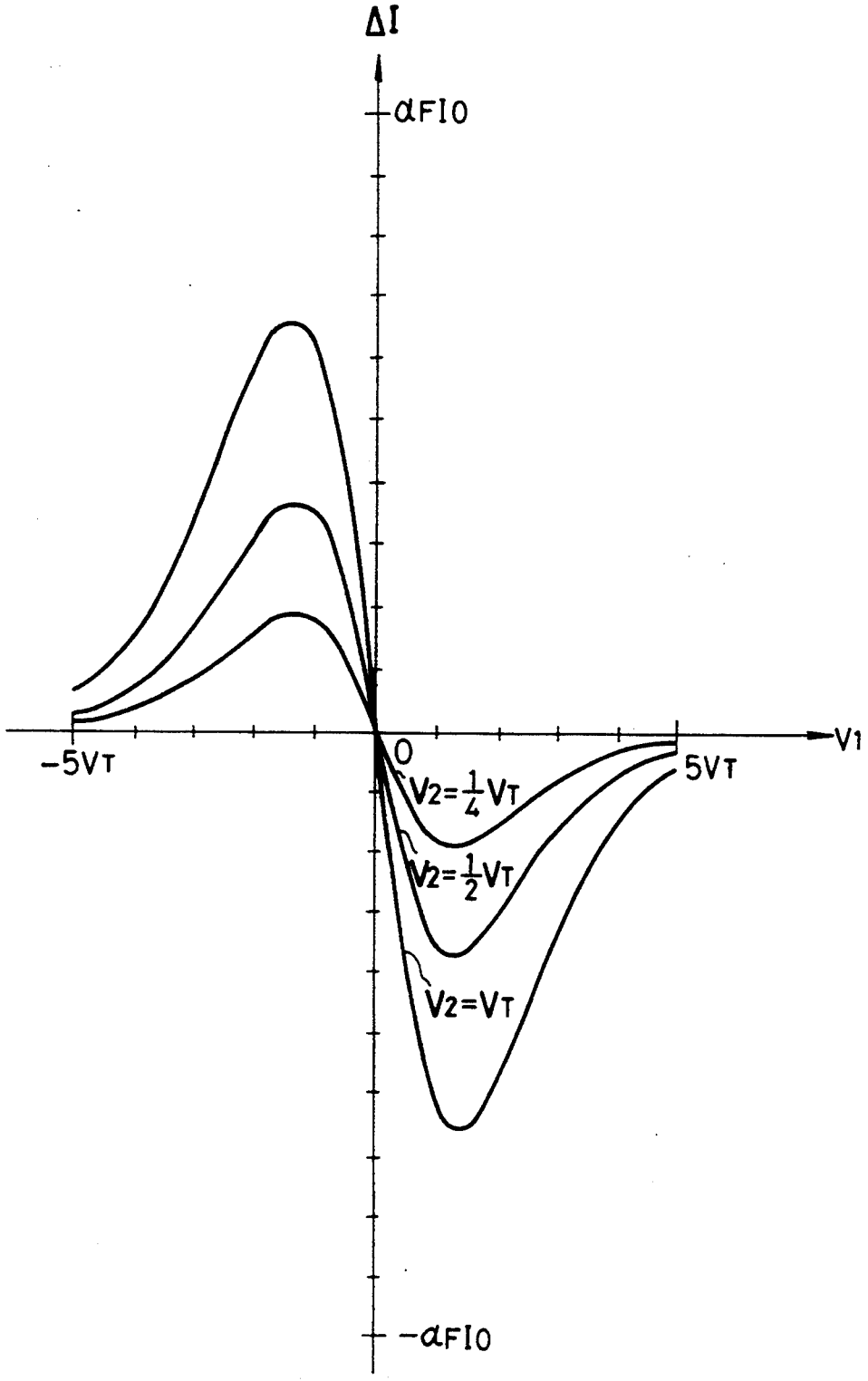
FIG. 7 is a diagram showing input-output characteristics of the multiplier shown in FIG. 6.

FIG. 7 shows a relation between the differential output current $\Delta I$ and the voltage $V_1$ with the voltage $V_2$ as a parameter. From FIG. 7, it can be seen that multiplying characteristics are obtained in the range that the absolute value of the voltage $V_1$ is about 1.5 $V_T$ or less.

Second Embodiment

Figure 8:
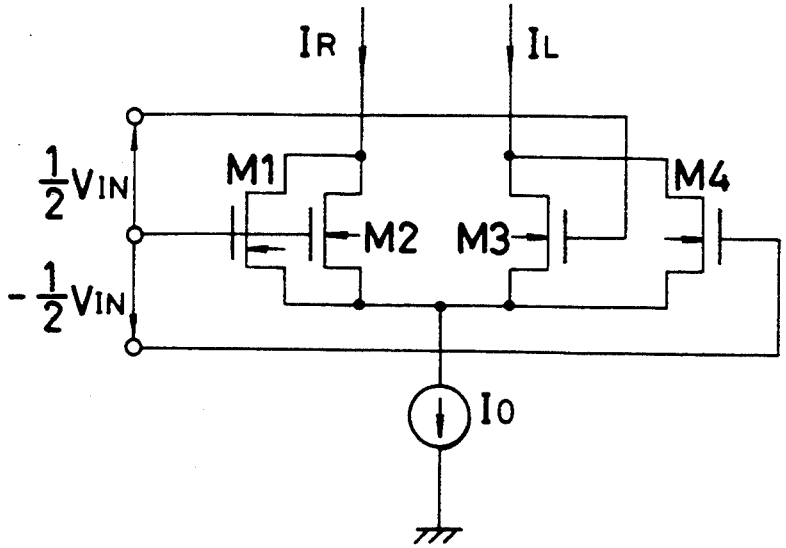
FIG. 8 is a circuit diagram of a quadritail circuit composed of MOS transistors.

FIG. 8 shows a quadritail circuit composed of MOS transistors M1, M2, M3, and M4, which is equivalent to that in FIG. 4.

Drain currents of the transistors M1, M2, M3 and M4 are defined as $I_{D1}$, $I_{D2}$, $I_{D3}$ and $I_{D4}$, and the sums of the drain currents are defined as $I_{D1}+I_{D2}=I_E$ and $I_{D3}+I_{D4}=I_L$, then $I_E+I_L=I_0$ is established. In the first embodiment using the bipolar transistors, the transconductance parameter is expressed by $\alpha_1$ or $\alpha_2$ in the prior art multiplier, it is expressed by $\beta$ here. The drain currents $I_{D1}$ and $I_{D2}$ are expressed as the following equation 27.

$$I_{D1}=I_{D2}=\beta(V_{GS}-V_{TH})^2 \tag{27}$$

The gates of the transistors M3 and M4 are respectively applied with the voltages $(\frac{1}{2})V_{IN}$ and $-(\frac{1}{2})V_{IN}$, so that the drain currents $I_{D3}$ and $I_{D4}$ can be given as the following equations 28–1 and 28–2, respectively.

$$I_{D3}=\beta(V_{GS}+V_{IN}/2-V_{TH})^2 \tag{28-1}$$

$$I_{D4}=\beta(V_{GS}-V_{IN}/2-V_{TH})^2 \tag{28-2}$$

Therefore, the currents $I_E$ and $I_L$ can be expressed as the following equations 29–1 and 29–2, respectively. From these equations, the both currents $I_E$ and $I_L$ have square-law characteristics with respect to the voltage $V_{IN}$.

$$I_E = I_0/2 - (\beta/4)V_{IN}^2 \quad (29\text{-}1)$$

$$I_L = I_0/2 + (\beta/4)V_{IN}^2 \quad (29\text{-}2)$$

Figure 9:
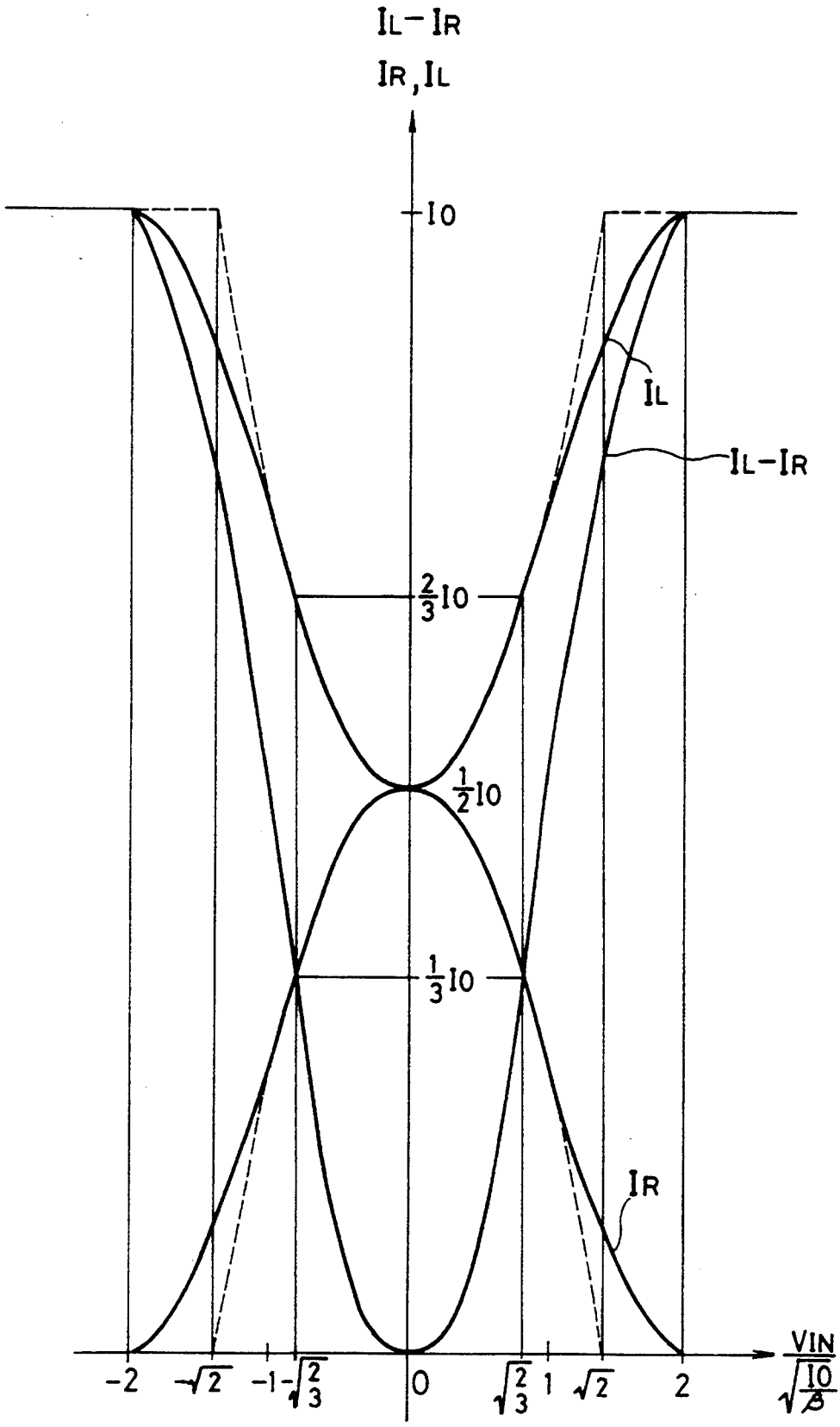
FIG. 9 is a diagram showing input-output characteristics of the quadritail circuit shown in FIG. 8.

In fact, the input-output characteristics of the quadritail circuit in FIG. 8 is obtained as shown in FIG. 9. It can be seen from FIG. 9 that the currents $I_E$ and $I_L$ respectively show ideal square-law characteristics in the input voltage range of $|V_{IN}| \leqq (2I_0/3\beta)^{\frac{1}{2}}$.

As described above, an approximate square-law characteristic can be realized in each quadritail circuit shown in FIG. 4, however, an accurate square-law characteristic can be realized in each quadritail circuit shown in FIG. 8.

Figure 10:
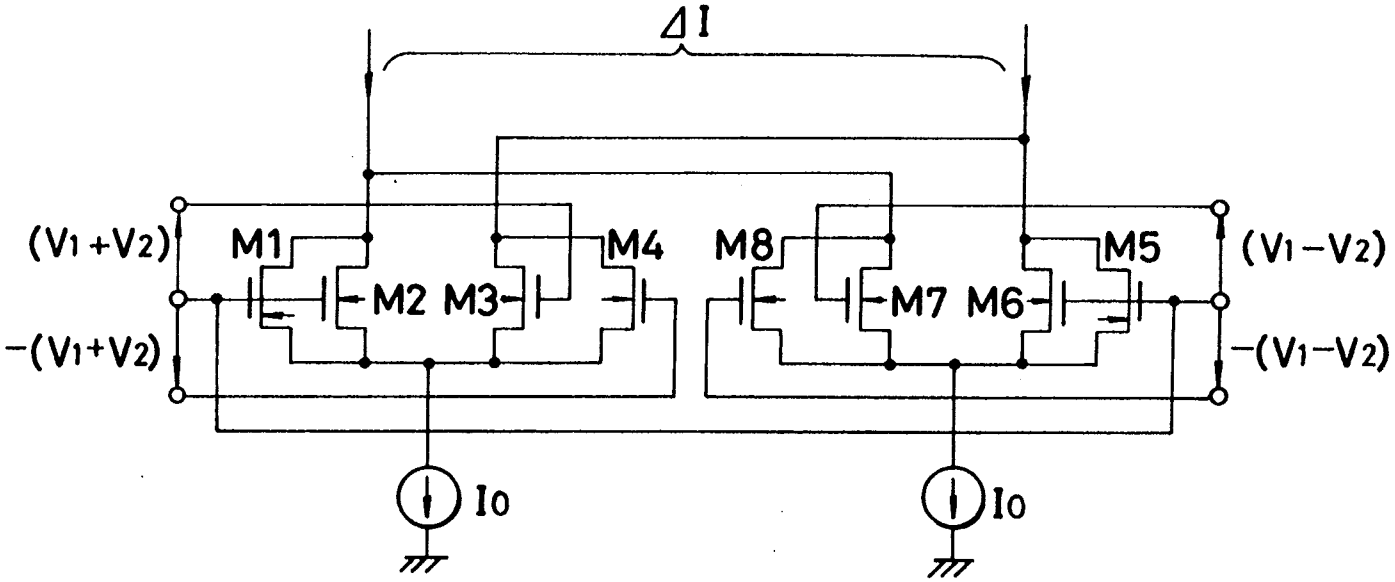
FIG. 10 is a circuit diagram of a multiplier according to a second embodiment of the present invention.

A multiplier according to a second embodiment of the present invention is shown in FIG. 10, which are composed of two MOS quadritail circuits shown in FIG. 8.

In FIG. 10, a first quadritail circuit on the left side, which is composed of MOS transistors M1, M2, M3 and M4 and a constant current source (current $I_0$), has a function corresponding to the first squarer 8 shown in FIG. 2, and a second quadritail circuit on the right side, which is composed of MOS transistors M5, M6, M7 and M8 and a constant current source (current $I_0$), has a function corresponding to the second squarer 9 shown in FIG. 2.

The first quadritail circuit on the left side has the same configuration as that of the MOS quadritail circuit shown in FIG. 8. The drains of the transistors M1 and M2 are connected in common, and the drains of the transistors M3 and M4 are connected in common. The gate of the transistor M3 is applied with the voltage $(V_1+V_2)$ and the gate of the transistor M4 is applied with the voltage $-(V_1+V_2)$ equal in absolute value and opposite in phase to the voltage $(V_1+V_2)$, with the common-connected gates of the transistors M1 and M2 as a reference. The common-connected gates of the transistor M1 and M2 are applied with a DC bias voltage, respectively, which is equal to the voltage at a middle point of the voltage applied between the gates of the transistors M3 and M4.

The sources of the transistors M1, M2, M3 and M4 are connected in common to the current source for driving them.

Similarly, a second quadritail circuit on the right side, the drains of the transistors M5 and M6 are connected in common, and the drains of the transistors M7 and M8 are connected in common. The gate of the transistor M7 is applied with the voltage $(V_1-V_2)$ and the gate of the transistor M8 is applied with the voltage $-(V_1-V_2)$ equal in absolute value and opposite in phase to the voltage $(V_1-V_2)$, with the common-connected gates of the transistors M5 and M6 as a reference. The common-connected gates of the transistor M5 and M6 are applied with a DC bias voltage, respectively, which is equal to the voltage at a middle point of the voltage applied between the gates of the transistors M7 and M8.

The sources of the transistors M5, M6, M7 and M8 are connected in common to the current source for driving them.

Between the first and second quadritail circuits, the common-connected gates of the transistors M1 and M2 are connected to the common-connected gates of the transistors M5 and M6. The drains of the transistors M1 and M2 and the drains of the transistors M7 and M8 are connected in common to form one of differential output ends. The drains of the transistors M3 and M4 and the drains of the transistors M5 and M6 are connected in common to form the other of the differential output ends.

In the multiplier having the above-described configuration, from the equations 29-1 and 29-2, a differential output current $\Delta I$ as shown in FIG. 10 is expressed as $\Delta I = 4\beta V_1 V_2$ in the range of $|V_1 \pm V_2| \leqq (\frac{1}{2})(2I_0/3\beta)^{\frac{1}{2}}$. This means that the differential output current $\Delta I$ shows a result of multiplication of the input voltages $V_1$ and $V_2$.

Figure 11:
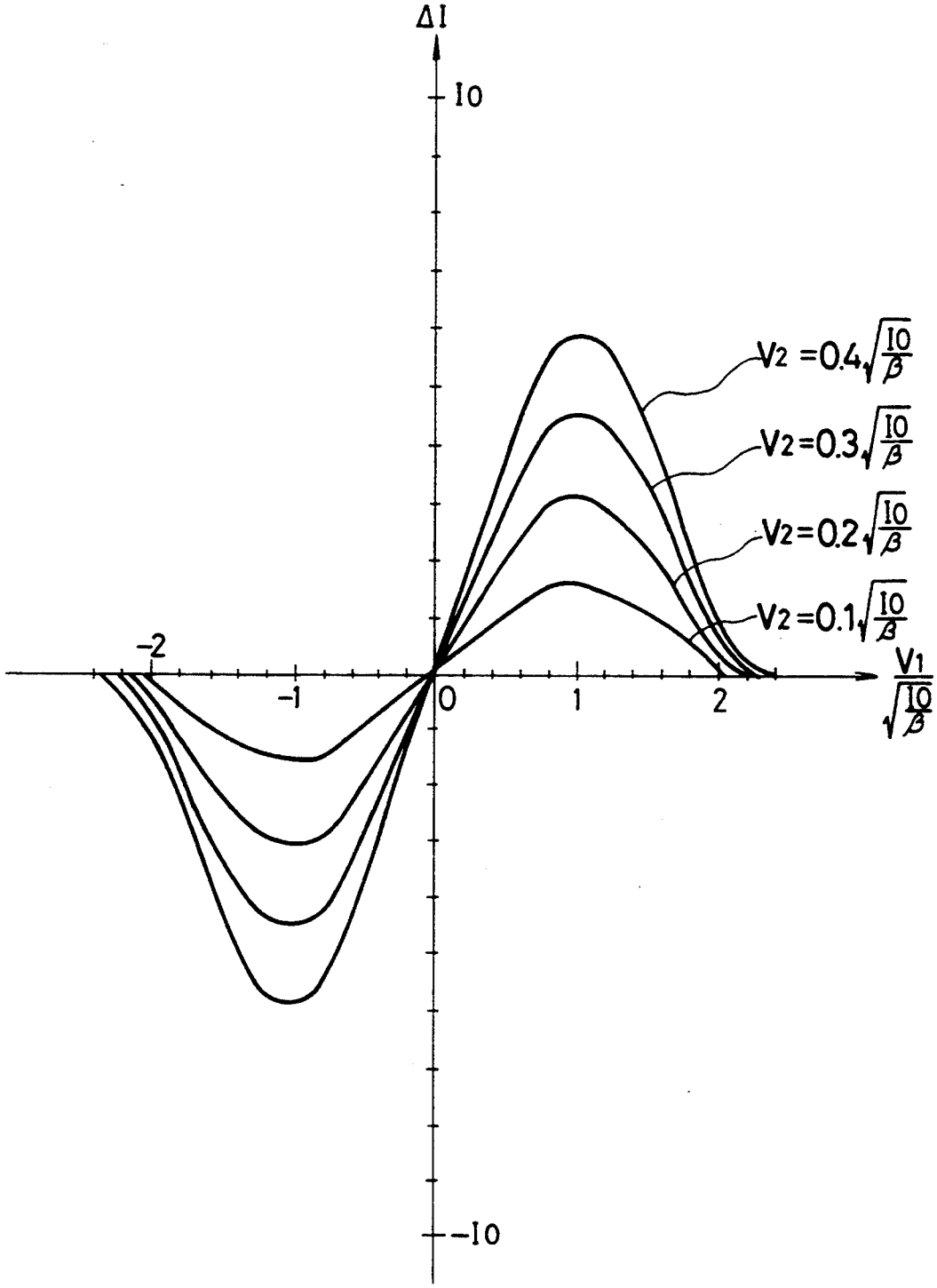
FIG. 11 is a diagram showing input-output characteristics of the multiplier shown in FIG. 10.
Figure 12:
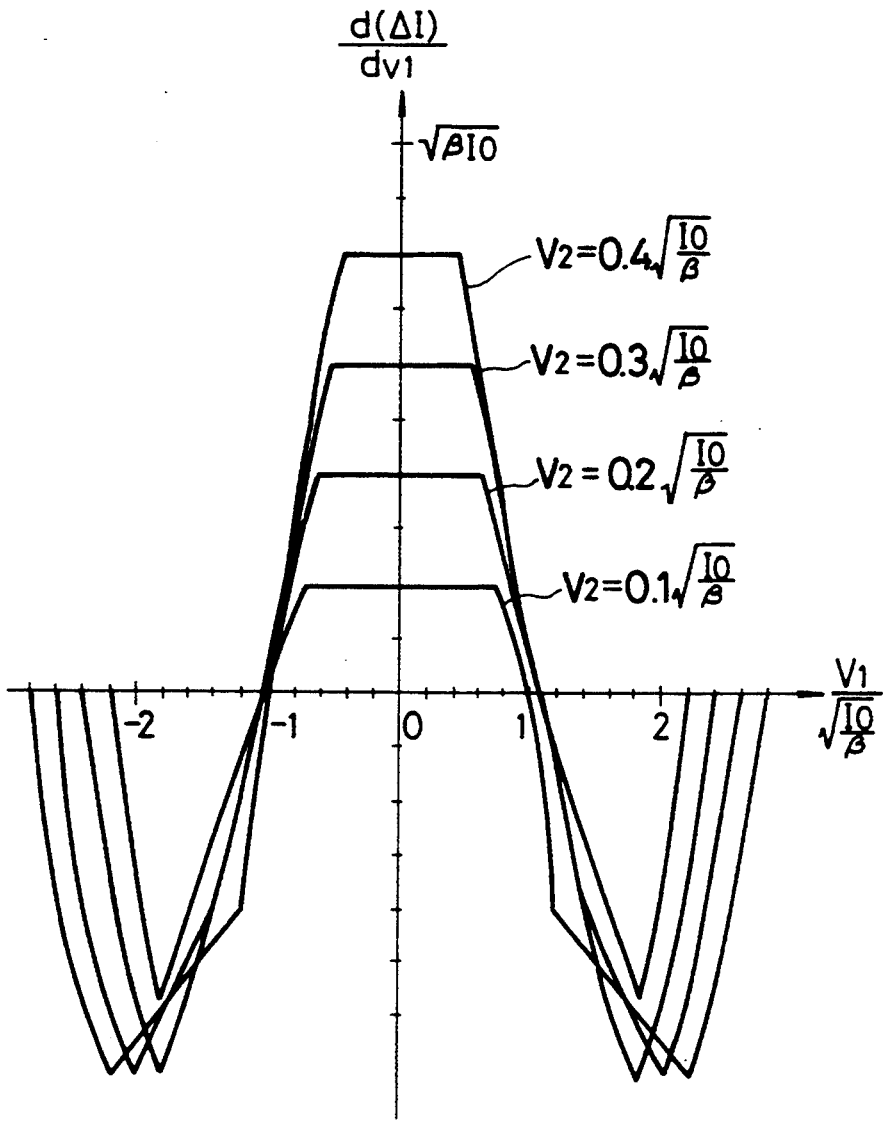
FIG. 12 is a diagram showing gain characteristics of the multiplier shown in FIG. 10.

The relation between the current $\Delta I$ and the voltage $V_1$ with the voltage $V_2$ as a parameter is shown in FIG. 11, and the gain characteristics of this multiplier is shown in FIG. 12.

Third Embodiment

Next, a multiplier according to a third embodiment on the present invention is described, in which the circuits for generating the voltages $(V_1+V_2)$ and $(V_1-V_2)$ are not required.

Figure 13:
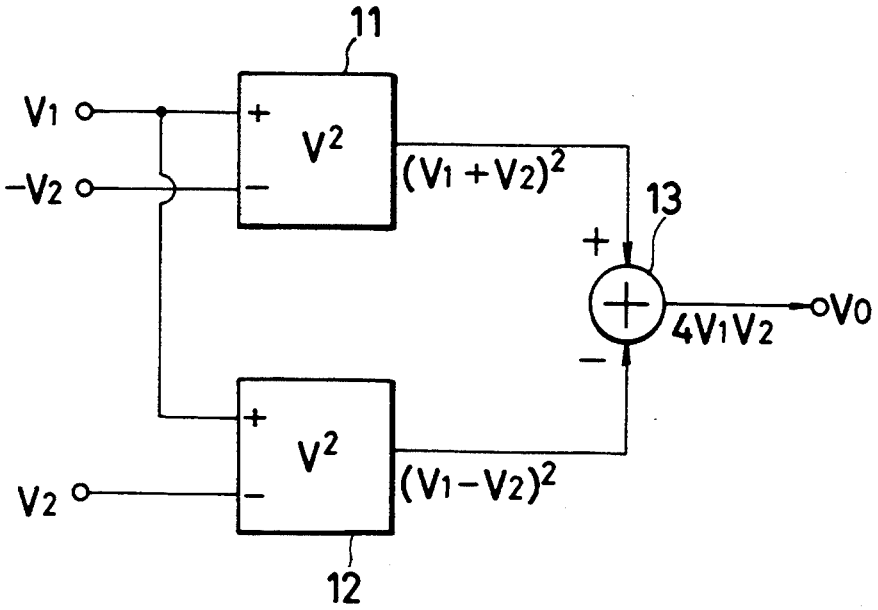
FIG. 13 PRIOR ART
FIG. 13 is a block diagram showing a multiplier using two quadritail circuits.

The multiplier of this embodiment is composed of two squarers 11 and 12 and a subtracter 13, as shown in FIG. 13. Each of the squarers 11 and 12 is composed of the above-described quadritail circuit. Also in the configuration, $V_0 = (V_1+V_2)^2 - (V_1-V_2)^2 = 4V_1V_2$ is established, so that a result of multiplication of the voltage $V_1$ and $V_2$ can be obtained.

The reason for being able to cancel the circuits for generating the voltages $(V_1+V_2)$ and $(V_1-V_2)$ is as follows: The squarers 11 and 12 have differential input ends, respectively, so that the difference voltage $(V_1-V_2)$ can be obtained by applying the voltages $V_1$ and $V_2$ to the differential input ends of the each squarer, respectively, and the sum voltage $(V_1+V_2)$ can be obtained by applying the voltage $V_1$ and the voltage $-V_2$ opposite in phase of the voltage $V_2$ to the differential input ends thereof.

To obtain an output signal opposite in phase to an input signal, it is required for an inverting amplifier. However, an inverting amplifier is simpler in configuration than an adder and a subtracter, so that it is very significant that the circuits for generating the sum and difference of the voltages $V_I$ and $V_2$ can be cancelled.

Figure 14:
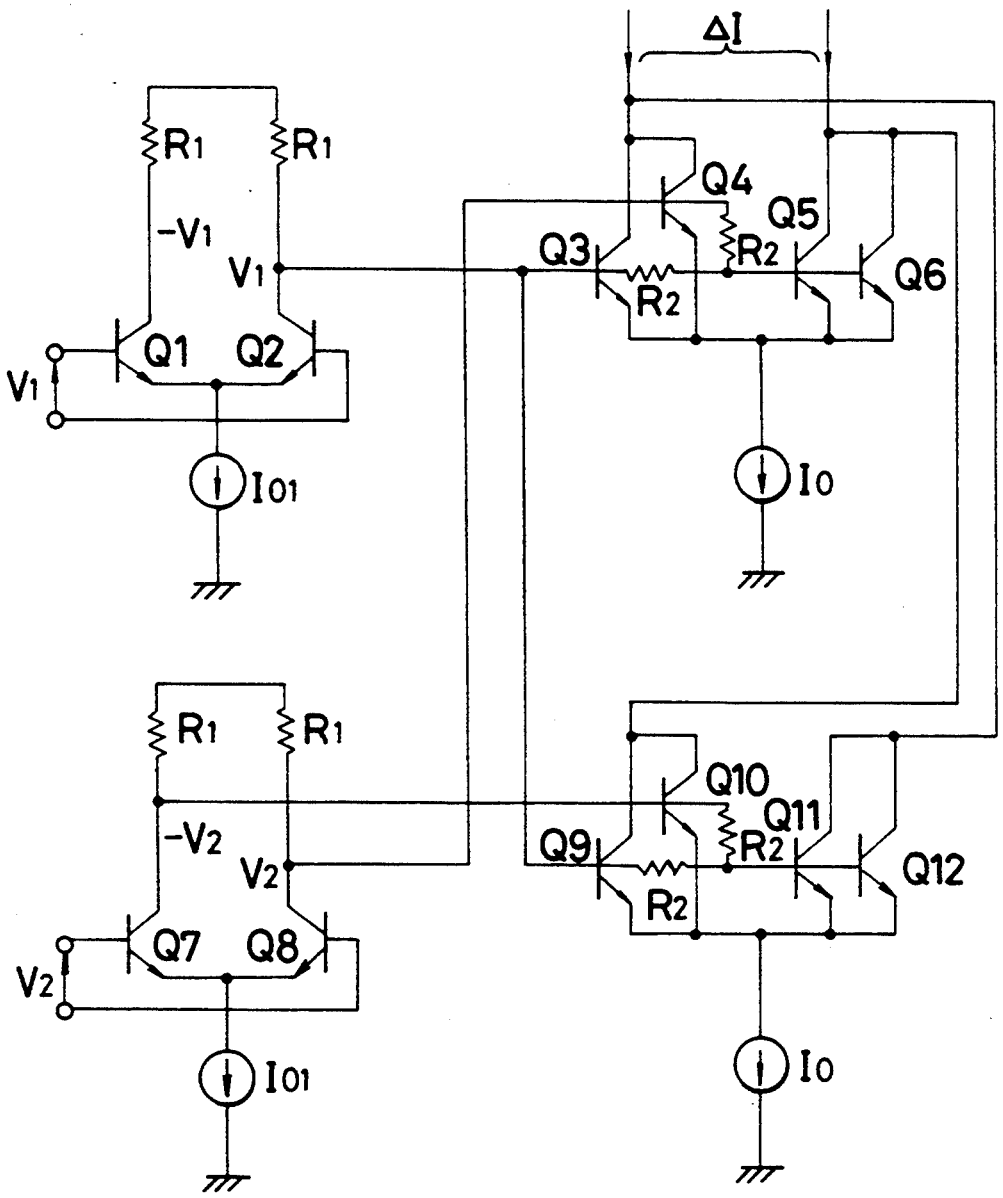
FIG. 14 is a circuit diagram of a multiplier according to a third embodiment of the present invention.

FIG. 14 shows a multiplier according to a third embodiment of the present invention using the configuration as shown in FIG. 13, which comprises two bipolar quadritail circuits. This multiplier is composed of the circuit shown in FIG. 6 and two differential pair of bipolar transistors Q1 and Q2, and Q7 and Q8. Therefore, a description about the circuit shown in FIG. 6 is omitted for the sake of simplification by attaching the same reference numerals to the corresponding elements, and the configuration about the differential pairs is only described here.

In FIG. 14, the second differential pair comprises the transistor Q1 and Q2 whose emitters are connected in common to a constant current source (current $I_{01}$) for driving them and whose collectors are connected through two load resistors (resistance $R_1$) to each other. The voltage $V_1$ is differentially applied between the bases of the transistors Q1 and Q2, and the inverted output voltage $-V_1$ and the non-inverted output voltage $V_1$ are generated at their collectors, respectively. Only the non-inverted output voltage $V_1$ is applied to the bases of the transistors Q3 and Q9 belonging to the second and first quadritail circuits, respectively.

Similarly, the first differential pair comprises the transistor Q7 and Q8 whose emitters are connected in common to a constant current source (current $I_{01}$) for driving them and whose collectors are connected through two load resistors (resistance $R_1$) to each other. The voltage $V_2$ is differentially applied between the bases of the transistors Q7 and Q8, and the inverted output voltage $-V_1$ and the non-inverted output voltage $V_1$ are generated at their collectors, respectively. The inverted output voltage $-V_2$ is applied to the base of the transistor Q10 belonging to the first quadritail circuit, and the non-inverted output voltage $V_2$ is applied to the base of the transistor Q4 belonging to the second quadritail circuit.

The second quadritail circuit has differential input ends, so that the middle point voltage which is obtained by dividing the voltage applied between the bases of the transistors Q3 and Q4 through the two resistor (resistance $R_2$) is applied to the common-connected bases of the transistors Q5 and Q6. About the first quadritail circuit, similarly, the middle point voltage obtained by dividing the voltage applied between the bases of the transistors Q9 and Q10 through the two resistor (resistance $R_2$) is applied to the common-connected bases of the transistors Q11 and Q12.

Accordingly, in the second quadritail circuit, with the middle point voltage at the common-connected bases of the transistors Q5 and Q6 as a reference, the voltages $+(\frac{1}{2})(V_1-V_2)$ and $-(\frac{1}{2})(V_1-V_2)$ are applied to the bases of the transistors Q3 and Q4, respectively. In the first quadritail circuit, with the middle point voltage at the common-connected bases of the transistors Q11 and Q12 as a reference, the voltages $+(\frac{1}{2})(V_1+V_2)$ and $-(\frac{1}{2})(V_1+V_2)$ are applied to the bases of the transistors Q9 and Q10, respectively.

Comparing the quadritail circuits of this embodiment with those of the first embodiment in FIG. 6, their input voltages are opposite in polarity or phase to each other. However, since the quadritail circuits serve to provide the square-law characteristics, there arises no problem due to the opposition in polarity or phase.

It should be noted that the input voltage in the multiplier of the third embodiment in FIG. 14 is half as much as that in the first embodiment in FIG. 6. In other words, the operating input voltage of the first embodiment is about 1.5 $V_T$ or less in absolute value, as shown in FIG. 7, however, in the third embodiment, it is increased to about 3 $V_T$.

From the equation 26, in this embodiment, the differential output current $\Delta I$ showing a result of multiplication is expressed as the following equation 30.

$$\Delta I = \frac{\alpha_F I_0}{\cosh^2\left(\frac{V_1+V_2}{4V_T}\right)} - \frac{\alpha_F I_0}{\cosh^2\left(\frac{V_1-V_2}{4V_T}\right)} \quad (30)$$

Fourth Embodiment

Figure 15:
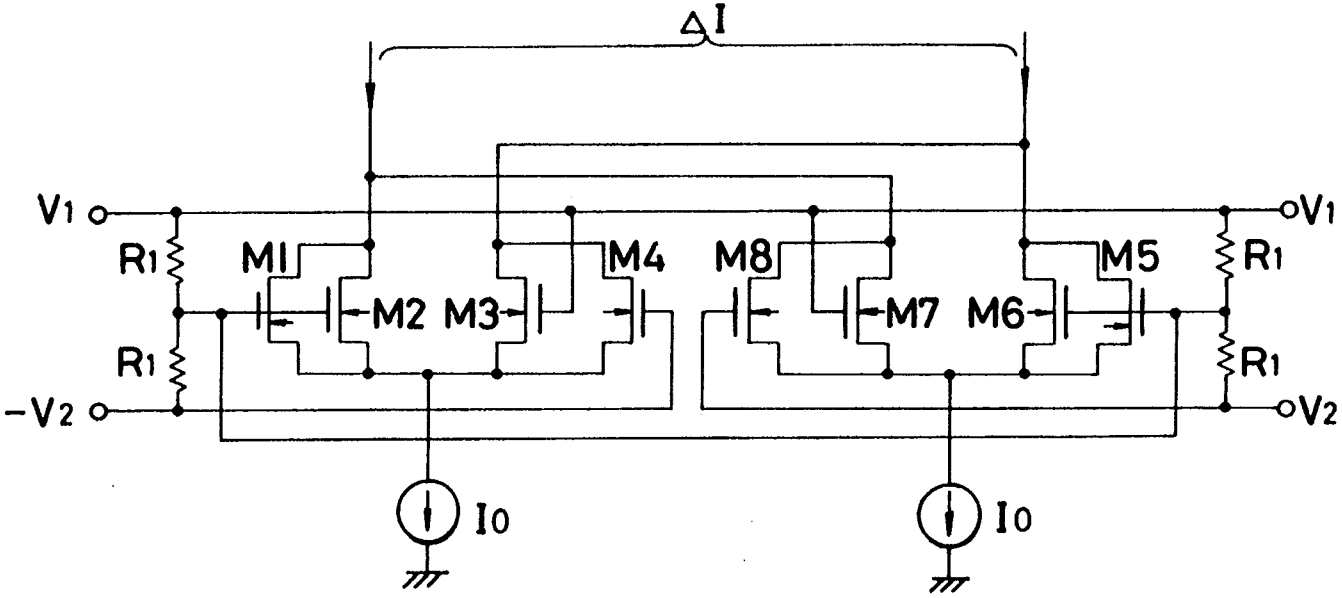
FIG. 15 is a circuit diagram of a multiplier according to a fourth embodiment of the present invention.

FIG. 15 shows a multiplier according to a fourth embodiment using two MOS quadritail circuits. This multiplier comprises the multiplier of the second embodiment shown in FIG. 10 and resistors (resistance $R_1$), so that the description about the circuit shown in FIG. 10 is omitted for the sake of simplification by attaching the same reference numerals to the corresponding elements. Also in the embodiment, the circuits for generating the voltages $(V_1+V_2)$ and $(V_1-V_2)$ are not required.

In FIG. 15, the common-connected gates of the transistors M1 and M2 is connected through a resistor (resistance $R_1$) to the gate of the transistor M3, on the one hand, and is connected through a resistor (resistance $R_1$) to the gate of the transistor M4, on the other hand. Similarly, the common-connected gates of the transistors M5 and M6 is connected through a resistor (resistance $R_1$) to the gate of the transistor M7, on the one hand, and is connected through a resistor (resistance $R_1$) to the gate of the transistor M8, on the other hand.

The gates of the transistors M3 and M7 are connected in common to be applied with the voltage $V_1$. The gate of the transistors M4 is applied with the opposite-phase voltage $-V_2$, and the gate of the transistor M8 is applied with the voltage $V_2$. The common-connected gates of the transistors M1 and M2 are applied with the middle point voltage $(\frac{1}{2})(V_1-V_2)$, and the common-connected gates of the transistors M5 and M6 are applied with the middle point voltage $(\frac{1}{2})(V_1+V_2)$.

In the multiplier of the fourth embodiment, the differential output current $\Delta I$ showing a result of multiplication can be expressed as $\Delta I=2\beta V_1V_2$ in the range of $|V_1\pm V_2|\leqq(2I_0/3\beta)^{\frac{1}{2}}$. Similar to the third embodiment, the operating input voltage range is increased to be twice as much as that of the first embodiment shown in FIG. 6.

Fifth Embodiment

Figure 16:
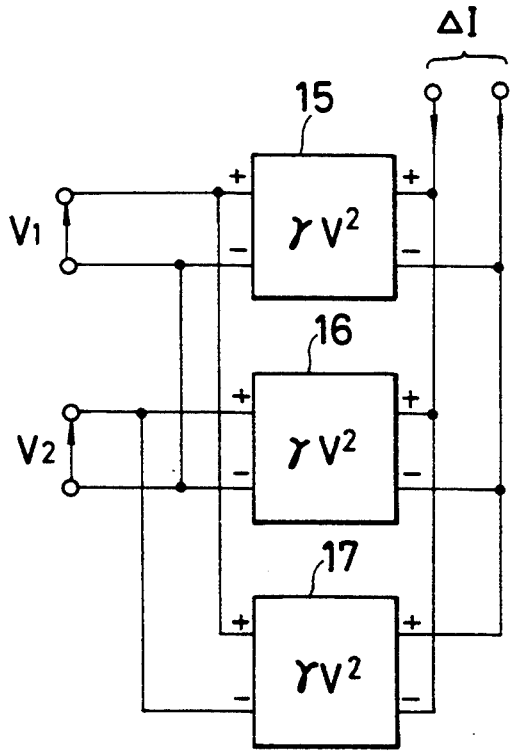
FIG. 16 is a block diagram showing a multiplier using three quadritail circuits.

A multiplier using three squarers is shown in FIG. 16, in which $\gamma$ shows the transconductance parameter. A first squarer 15 has differential input ends to be applied with the first input voltage $V_1$, a second squarer 16 has differential input ends to be applied with the second input voltage $V_2$, and a third squarer 17 has differential input ends to be applied with the difference $(V_1-V_2)$ of the first and second input voltages $V_1$ and $V_2$.

The positive-phase output end of the first squarer 15, the positive-phase output end of the second squarer 16 and the negative-phase output end of the third squarer 17 are connected in common to form one of differential output ends. The negative-phase output end of the first squarer 15, the negative-phase output end of the second squarer 16 and the positive-phase output end of the third squarer 17 are connected in common to form the other of the differential output ends. The differential output current $\Delta I$ is derived from the differential output ends thus formed.

The differential output current $\Delta I$ can be expressed as the following equation 31, from which the circuit shown in FIG. 16 has a multiplication characteristics is seen.

$$\Delta I=\gamma V_1^2+\gamma V_2^2-\gamma(V_1-V_2)^2=2\gamma V_1V_2 \quad (31)$$

In FIG. 16, the respective negative-phase output ends of the first and second squarers 15 and 16 are connected in common, however, these output ends may be disconnected or floating. If they are made floating, there is an advantage that such differential input voltages as in the first to fourth embodiments are not required.

Besides, since the differential output current of the quadritail circuit does not contain a DC component, there arises no offset current in it even if a multiplier is composed of an odd number of the quadritail circuits. As a result, there is another advantage that no additional circuit is required for cancelling the offset at the output ends of the multiplier.

Figure 17:
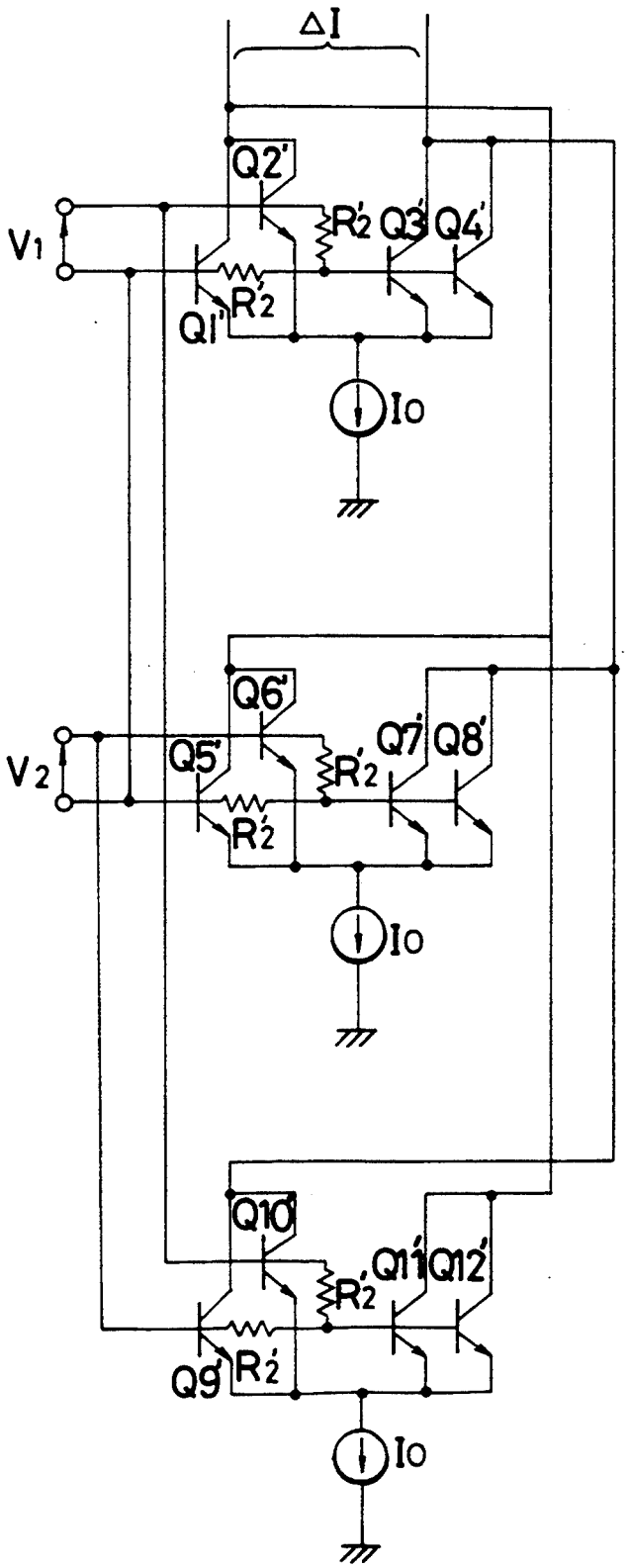
FIG. 17 is a circuit diagram of a multiplier according to a fifth embodiment of the present invention.

FIG. 17 shows a multiplier according to a fifth embodiment of the present invention in which three bipolar quadritail circuits are used. The multiplier is composed of first, second and third quadritail circuits each of which has the same configuration as that shown in FIGS. 6 and 14. A first quadritail circuit on the upper side acts as the first squarer 15 shown in FIG. 16, the second quadritail circuit in the middle acts as the second squarer 16, and the third quadritail circuit on the lower side acts as the third squarer 17.

The first quadritail circuit is composed of bipolar transistors Q1', Q2', Q3' and Q4', a constant current source (current $I_0$) and resistor (resistance $R_2'$), the second quadritail circuit is composed of bipolar transistors Q5', Q6', Q7' and Q8', a constant current source (current $I_0$) and resistor (resistance $R_2'$), and the third quadritail circuit is composed of bipolar transistors Q9', Q10', Q11' and Q12', a constant current source (current $I_0$) and resistor (resistance $R_2'$).

In the first quadritail circuit, The collectors of the transistors Q1' and Q2' are connected in common, and the collectors of the transistors Q3' and Q4' are connected in common. The voltage $V_1$ is applied between the bases of the transistors Q1' and Q2'. The bases of the transistors Q3' and Q4' are connected in common to the base of the transistor Q1' through the resistor (resistance $R_2'$), on the one hand, and to the base of the transistor Q2' through the resistor (resistance $R_2'$), on the other hand; and as a result, the common-connected bases of the transistor Q3' and Q4' are applied with a DC bias voltage, respectively. This DC bias voltage is equal to the voltage at a middle point of the voltage applied between the bases of the transistors Q1' and Q2' , or $(\frac{1}{2})V_1$.

The emitters of the transistors Q1', Q2', Q3' and Q4' are connected in common to the current source for driving them.

Similarly, in the second quadritail circuit, the collectors of the transistors Q5' and Q6' are connected in common, and the collectors of the transistors Q7' and Q8' are connected in common. The voltage $V_2$ is applied between the bases of the transistors Q5' and Q6'. The bases of the transistors Q7' and Q8' are connected in common to the base of the transistor Q5' through the resistor (resistance $R_2'$), on the one hand, and to the base of the transistor Q6' through the resistor (resistance $R_2'$), on the other hand; and as a result, the common-connected bases of the transistor Q7' and Q8' are applied with a DC bias voltage, respectively. This DC bias voltage is equal to the voltage at a middle point of the voltage applied between the bases of the transistors Q5' and Q6', or $(\frac{1}{2})V_2$.

The emitters of the transistors Q5', Q6', Q7' and Q8' are connected in common to the current source for driving them.

In the third quadritail circuit, the collectors of the transistors Q9' and Q10' are connected in common, and the collectors of the transistors Q11' and Q12' are connected in common. The difference voltage $(V_1-V_2)$ is applied between the bases of the transistors Q9' and Q10'. The bases of the transistors Q11' and Q2' are connected in common to the base of the transistor Q9' through the resistor (resistance $R_2'$), on the one hand, and to the base of the transistor Q10' through the resistor (resistance $R_2'$), on the other hand; and as a result, the common-connected bases of the transistor Q7' and Q8' are applied with a DC bias voltage, respectively. This DC bias voltage is equal to the voltage at a middle point of the voltage applied between the bases of the transistors Q9' and Q10', or $(\frac{1}{2})(V_1-V_2)$.

The emitters of the transistors Q9', Q10', Q11' and Q12' are connected in common to the current source for driving them.

Among the first, second and third quadritail circuits, the common-connected collectors (positive-phase side) of the transistors Q1' and Q2', the common-connected collectors (positive-phase side) of the transistors Q5' and Q6' and the common-connected collectors (negative-phase side) of the transistors Q9' and Q10' are connected in common to form one of differential output ends. Similarly, the common-connected collectors (negative-phase side) of the transistors Q3' and Q4', the common-connected collectors (negative-phase side) of the transistors Q7' and Q8' and the common-connected collectors (positive-phase side) of the transistors Q11' and Q12' are connected in common to form the other of the differential output ends. The differential output currents $\Delta I$ showing a result of multiplication is derived from the differential output ends thus formed (see the equation 31).

As described above, the bipolar quadritail circuit has the square-law characteristic as shown in FIG. 5, so that the operating input voltage range which can be considered to have the square-law characteristic is determined with respect to each quadritail circuit. Therefore, the multiplier of the fifth embodiment shown in FIG. 16 is narrower in operating input voltage range than that of the third embodiment shown in FIG. 14.

Sixth embodiment

Figure 18:
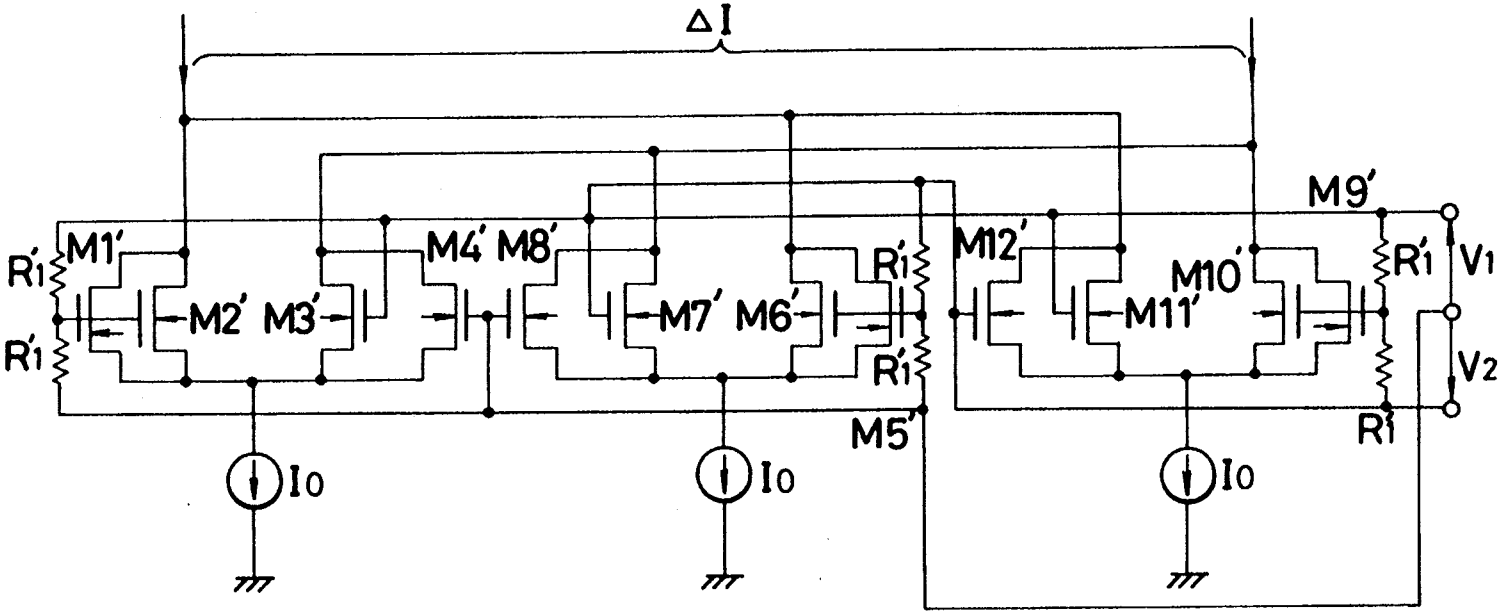
FIG. 18 is a circuit diagram of a multiplier according to a sixth embodiment of the present invention.

FIG. 18 shows a multiplier according to a sixth embodiment of the present invention in which three MOS quadritail circuits are used. This multiplier is similar in configuration to that of the fourth embodiment shown in FIG. 15.

In FIG. 18, a first quadritail circuit on the left side is composed of MOS transistors M1', M2', M3' and M4' and a constant current source (current $I_0$). The drains of the transistors M1' and M2' are connected in common, and the drains of the transistors M3' and M4' are connected in common. The gates of the transistors M3' and M4' are respectively applied with the voltages $V_1$ and $V_2$. The common-connected gates of the transistors M1' and M2' are connected to the gate of the transistor M3' through a resistor (resistance $R_1'$), on the one hand, and to the gate of the transistors M4' through a resistor (resistance $R_1'$), on the other hand. The common-connected gates of the transistors M1' and M2' are applied with the middle point voltage $(\frac{1}{2})V_1$.

The sources of the transistors M1', M2', M3' and M4' are connected in common to the constant current source.

A second quadritail circuit in the middle is composed of MOS transistors M5', M6', M7' and M8' and a constant current source (current $I_0$). The drains of the transistors M5' and M6' are connected in common, and the drains of the transistors M7' and M8' are connected in common. The gates of the transistors M7' and M8' are respectively applied with the voltages $V_1$ and $V_2$. The common-connected gates of the transistors M5' and M6' are connected to the gate of the transistor M7' through a resistor (resistance $R_1'$), on the one hand, and to the gate of the transistors M8' through a resistor (resistance $R_1'$), on the other hand. The common-connected gates of the transistors M5' and M6' are applied with the middle point voltage $(\frac{1}{2})$ $V_2$.

The sources of the transistors M5', M6', M7' and M8' are connected in common to the constant current source.

Similarly, a third quadritail circuit on the right side is composed of MOS transistors M9', M10', M11' and M12' and a constant current source (current $I_0$). The drains of the transistors M9' and M10' are connected in common, and the drains of the transistors M11' and M12' are connected in common. The gates of the transistors M11' and M12' are respectively applied with the voltages $V_1$ and $V_2$. The common-connected gates of the transistors M9' and M10' are connected to the gate of the transistor M11' through a resistor (resistance $R_1'$), on the one hand, and to the gate of the transistors M12' through a resistor (resistance $R_1'$), on the other hand. The common-connected gates of the transistors M9' and M10' are applied with the middle point voltage $(\frac{1}{2})(V_1-V_2)$.

The sources of the transistors M9', M10', M11' and M12' are connected in common to the constant current source.

Among the first, second and third quadritail circuits, the common-connected drains (positive-phase side) of the transistors M1' and M2', the common-connected drains (positive-phase side) of the transistors M5' and M6' and the common-connected drains (negative-phase side) of the transistors M11' and Q12' are connected in common to form one of differential output ends. The common-connected drains (negative-phase side) of the transistors M3' and M4', the common-connected drains (negative-phase side) of the transistors M7' and M8' and the common-connected drains (positive-phase side) of the transistors M11' and M12' are connected in common to form the other of the differential output ends. The differential output currents $\Delta I$ showing a result of multiplication is derived from the differential output ends thus formed (see the equation 31).

The square-law characteristic of the MOS quadritail circuit is determined by the ratio (W/L) of the gate-width W and gate-length L and the current value of the constant current source, as shown in FIG. 6. Therefore, to drive the multiplier of this embodiment by using the same constant current sources and to ensure the operating input voltage range equivalent to that of the multiplier in FIG. 14, the ratio (W/L) is required to be small. Concretely, the gate-width W is made narrower, and/or the gate-length L is made longer.

Seventh Embodiment

Figure 19:
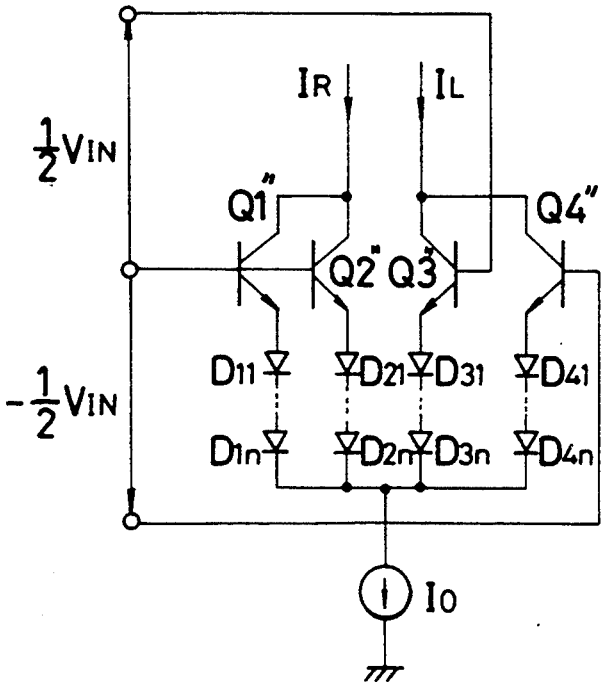
FIG. 19 is a circuit diagram of a quadritail circuit used for a multiplier according to a seventh embodiment of the present invention.

FIG. 19 shows a quadritail circuit used for a multiplier according to a seventh embodiment of the present invention. The quadritail circuit has the same configuration as that in FIG. 4, excepting that each of the bipolar transistors Q1", Q2", Q3" and Q4" has series-connected n diodes $D_{1l}$ to $D_{1n}$, $D_{2l}$ to $D_{2n}$, $D_{3l}$ to $D_{3n}$ and $D_{4l}$ to $D_{4n}$ at their emitters, where n is a natural number. In this quadritail circuit, the operating input voltage range which can be considered to have the square-law characteristic is increased to be n times as much as that shown in FIG. 4.

Therefore, if the quadritail circuit shown in FIG. 19 is applied into the multiplier of the fifth embodiment using three bipolar quadritail circuits shown in FIG. 17 in place of that in FIG. 4, the operating input voltage range of the multiplier can be increased to be n times. However, its operating power source voltage is increased by $(0.6\times n)$ volts.

Eighth Embodiment

Figure 1:
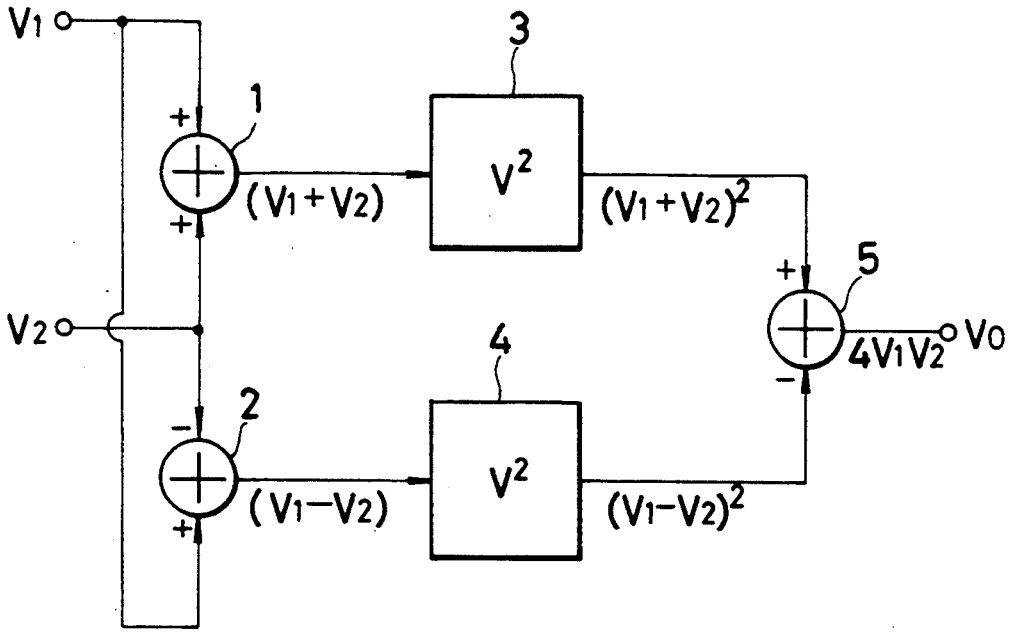
FIG.1 PRIOR ART
FIG. 1 is a block diagram showing a prior art multiplier.
Figure 20:
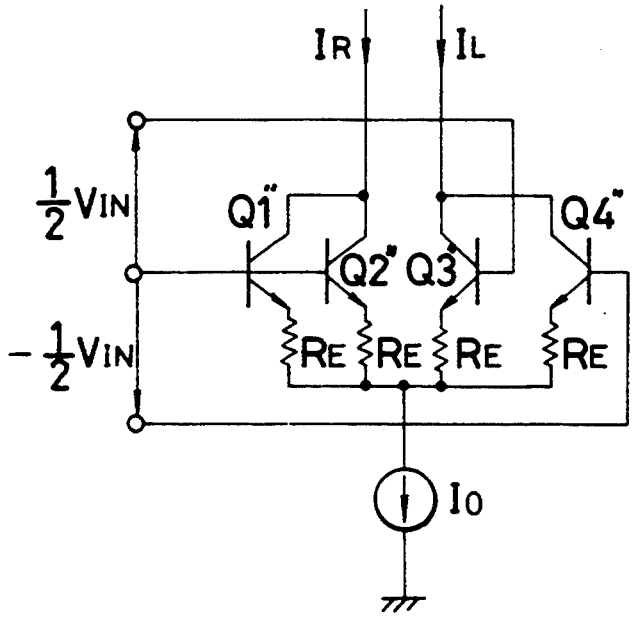
FIG. 20 is a circuit diagram of a quadritail circuit used for a multiplier according to a eighth embodiment of the present invention.

FIG. 20 shows a quadritail circuit used for a multiplier according to a eighth embodiment of the present invention. The quadritail circuit also has the same configuration as that in FIG. 4, excepting that each of the bipolar transistors Q1", Q2", Q3" and Q4" has an resistor (resistance $R_1$) at its emitter.

It is well known that the operating input voltage range can be increased corresponding to the product $R_E I_O$ of the resistance value $E_E$ and the current value $I_O$. In this quadritail circuit, the square-law characteristic is realized approximately, so that there is a particular value of the product $R_E I_O$ in which the square-law characteristic is made better. Practically, it can be said that the particular value of the product $R_E I_O$ is about 10 $V_T$ if some tolerance is acceptable. Therefore, the operating input voltage range is increased to be about 5 times as much as that shown in FIG. 4.

In the above-described embodiments, there are provided with two or three quadritail circuits each of which are connected in common at their output ends to form a pair of differential output ends, and the output current is derived from the pair of the output ends differentially. However, output currents may be derived from either differential output ends to input a subtracter, and then a result of multiplication may be obtained from the subtracter.

In addition, in the quadritail circuit, two transistors of one differential pair have emitters, bases and collectors connected in common, respectively, or have sources, gates and drains connected in common, respectively. As a result, one transistor which is twice in capacity as much as one of these two transistors may be used in place of the differential pair.

What is claimed is:

1. A multiplier comprising:

a first quadritail circuit containing a first pair of first and second transistors whose capacities are the same and whose output ends are connected in common, a second pair of third and fourth transistors whose capacities are the same and whose output ends are connected in common, and a first constant current source for driving said first pair and said second pair; and a second quadritail circuit containing a third pair of fifth and sixth transistors whose capacities are the same and whose output ends are connected in common, a fourth pair of seventh and eighth transistors whose capacities are the same and whose output ends are connected in common, and a second constant current source for driving said third pair and said fourth pair; wherein in said first quadritail circuit, input ends of said first pair are respectively applied with voltages which are opposite in phase to each other and equal in absolute value to sum of a first input voltage and a second input voltage;

input ends of said second pair are connected in common to be applied with a voltage at a middle point of a voltage applied between said input ends of said first pair;

in said second quadritail circuit, input ends of said third pair are respectively applied with voltages which are opposite in phase to each other and equal in absolute value to difference of said first input voltage and said second input voltage;

input ends of said fourth pair are connected in common to be applied with a voltage at a middle point of a voltage applied between said input ends of said third pair; and said common-connected output ends of said first pair and said common-connected output ends of said fourth pair are connected in common to form one of differential output ends, and said common-connected output ends of said second pair and said common-connected output end of said third pair are connected in common to form the other of said differential output ends.

2. The multiplier as claimed in claim 1, wherein said first to eighth transistors are bipolar transistors;

bases of said third transistor and said fourth transistor are connected in common to be connected through a first resistor to a base of said first transistor on the one hand, and to be connected through a second resistor whose resistance value is equal to that of said first resistor to a base of said second transistor, on the other hand; and bases of said seventh transistor and said eighth transistor are connected in common to be connected through a third resistor to a base of said fifth transistor on the one hand, and to be connected through a fourth resistor whose resistance value is equal to that of said third resistor to a base of said sixth transistor, on the other hand.

3. The multiplier as claimed in claim 2, wherein each of said first to fourth transistors of said first quadritail circuit has at least one diode at a corresponding emitter of each of said first to fourth transistors, and emitters of said first to fourth transistors are connected through said diode to said first constant current source, respectively; and each of said fifth to eighth transistors of said second quadritail circuit has at least one diode at a corresponding emitter of each of said fifth to eighth transistors, and emitters of said fifth to eighth transistors are connected through said diode to said second constant current source, respectively.

4. The multiplier as claimed in claim 2, wherein each of said first to fourth transistors of said first quadritail circuit has a resistor at a corresponding emitter of each of said first to fourth transistors, and emitters of said first to fourth transistors are connected through said resistor to said first constant current source, respectively; and each of said fifth to eights transistors of said second quadritail circuit has a resistor at a corresponding emitter of each of said fifth to eigth transistors, and emitters of said fifth to eighth transistors are connected through said resistors to said second constant current source, respectively.

5. The multiplier as claimed in claim 1, wherein said first to eighth transistors are MOS transistors;

gates of said third transistor and said fourth transistor are respectively applied with said voltages which are opposite in phase to each other and equal in absolute value to sum of said first input voltage and said second input voltage, with common-connected gates of said first transistor and said second transistor as a reference;

said common-connected gates of said first transistor and said second transistor are applied with a voltage at a middle point of said voltage applied between said gates of said third transistor and said fourth transistor;

gates of said seventh transistor and said eighth transistor are respectively applied with said voltages which are opposite in phase to each other and equal in absolute value to difference of said first input voltage and said second input voltage, with common-connected gates of said fifth transistor and said sixth transistor as a reference; and said common-connected gates of said fifth transistor and said sixth transistor are applied with said voltage at a middle point of said voltage applied between said gates of said seventh transistor and said eighth transistor.

6. A multiplier comprising:

a first quadritail circuit containing a first pair of first and second transistors whose capacities are the same and whose output ends are connected in common, a second pair of third and fourth transistors whose capacities are the same and whose output ends are connected in common, and a first constant current source for driving said first pair and said second pair; and a second quadritail circuit containing a third pair of fifth and sixth transistors whose capacities are the same and whose output ends are connected in common, a fourth pair of seventh and eighth transistors whose capacities are the same and whose output ends are connected in common, and a second constant current source for driving said third pair and said fourth pair; wherein in said first quadritail circuit, input ends of said first pair are respectively applied with a first input voltage and a second input voltage;

input ends of said second pair are connected in common to be applied with a voltage at a middle point of a voltage applied between said input ends of said first pair;

in said second quadritail circuit, one of input ends of said third pair is applied with said first voltage with the same phase as that of said first pair and the other of said input ends is applied with said second voltage with opposite phase to that of said first pair;

input ends of said fourth pair are connected in common to be applied with a voltage at a middle point of a voltage applied between said input ends of said third pair; and said common-connected output ends of said first pair and said common-connected output ends of said fourth pair are connected in common to form one of differential output ends, and said common-connected output ends of said second pair and said common-connected output end of said third pair are connected in common to form the other of said differential output ends.

7. The multiplier as claimed in claim 6, wherein said first to eighth transistors are bipolar transistors;

bases of said third transistor and said fourth transistor are connected in common to be connected through a first resistor to a base of said first transistor on the one hand, and to be connected through a second resistor whose resistance value is equal to that of said first resistor to a base of said second transistor, on the other hand; and bases of said seventh transistor and said eighth transistor are connected in common to be connected through a third resistor to a base of said fifth transistor on the one hand, and to be connected through a fourth resistor whose resistance value is equal to that of said third resistor to a base of said sixth transistor, on the other hand.

8. The multiplier as claimed in claim 7, wherein each of said first to fourth transistors of said first quadritail circuit has at least one diode at a corresponding emitter of each of said first to fourth transistors, and emitters of said first to fourth transistor are connected through said diode to said first constant current source, respectively; and each of said fifth to eighth transistors of said second quadritail circuit has at least one diode at a corresponding emitter of each of said fifth to eighth transistors, and emitters of said fifth to eighth transistors are connected through said diode to said second constant current source, respectively.

9. The multiplier as claimed in claim 7, wherein each of said first to fourth transistors of said first quadritail circuit has a resistor at a corresponding emitter of each of aid first to fourth transistors, and emitters of said first to fourth transistors are connected through said resistor to said first constant current source, respectively; and each of said fifth to eighth transistors of said second quadritail circuit has a resistor at a corresponding emitter of each of said fifth to eighth transistors, and emitters of said fifth to eighth transistors are connected through said resistors to said second constant current source, respectively.

10. The multiplier as claimed in claim 6, further comprises a first differential pair for generating said first input voltage and a second differential pair for generating said second input voltage; wherein said first differential pair contains a ninth transistor and tenth transistor, a third constant current source for driving said first differential pair and a first load resistor;

said second differential pair contains an eleventh transistor and twelfth transistor, a fourth constant current source for driving said second differential pair and a second load resistor; and said first input voltage is applied between differential input ends of said first differential pair, and two voltages opposite in phase and equal in absolute value to said first input voltage are generated at output ends of said first differential pair, respectively; and said second input voltage is applied between differential input ends of said second differential pair, and two voltages opposite in phase and equal in absolute value to said second input voltage are generated at output ends of said second differential pair, respectively.

11. The multiplier as claimed in claim 6, wherein said first to eighth transistors are MOS transistors;

gates of said third transistor and said fourth transistor are respectively applied with said voltages which are opposite in phase to each other and equal in absolute value to sum of said first input voltage and said second input voltage, with common-connected gates of said first transistor and said second transistor as a reference;

said common-connected gates of said first transistor and said second transistor are applied with a voltage at a middle point of said voltage applied between said gates of said third transistor and said fourth transistor;

gates of said seventh transistor and said eighth transistor are respectively applied with said voltages which are opposite in phase to each other and equal in absolute value to difference of said first input voltage and said second input voltage, with common-connected gates of said fifth transistor and said sixth transistor as a reference; and said common-connected gates of said fifth transistor and said sixth transistor are applied with said voltage at a middle point of said voltage applied between said gates of said seventh transistor and said eighth transistor.

12. The multiplier as claimed in claim 11, wherein gates of said first transistor and said second transistor are connected in common to be connected through a first resistor to a gate of said third transistor on the one hand, and to be connected through a second resistor whose resistance value is equal to that of said first resistor to a gate of said fourth transistor, on the other hand; and gates of said fifth transistor and said sixth transistor are connected in common to be connected through a third resistor to a gate of said seventh transistor on the one hand, and to be connected through a fourth resistor whose resistance value is equal to that of said third resistor to a gate of said eighth transistor, on the other hand.

13. A multiplier comprising:

a first quadritail circuit containing a first pair of first and second transistors whose capacities are the same and whose output ends are connected in common, a second pair of third and fourth transistors whose capacities are the same and whose output ends are connected in common, and a first constant current source for driving said first pair and said second pair;

a second quadritail circuit containing a third pair of fifth and sixth transistors whose capacities are the same and whose output ends are connected in common, a fourth pair of seventh and eighth transistors whose capacities are the same and whose output ends are connected in common, and a second constant current source for driving said third pair and said fourth pair;

a third quadritail circuit containing a fifth pair of ninth and tenth transistors whose capacities are the same and whose output ends are connected in common, a sixth pair of eleventh and twelfth transistors whose capacities are the same and whose output ends are connected in common, and a third constant current source for driving said fifth pair and said sixth pair; wherein in said first quadritail circuit, input ends of said first pair are applied with a first input voltage, and input ends of said second pair are connected in common to be applied with a voltage at a middle point of a voltage applied between said input ends of said first pair;

in said second quadritail circuit, input ends of said third pair are applied with a second input voltage, and input ends of said fourth pair are connected in common to be applied with a voltage at a middle point of a voltage applied between said input ends of said third pair;

in said third quadritail circuit, one of input ends of said fifth pair is applied with said first voltage and the other of said input ends of said fifth pair is applied with said second voltage with opposite phase to that of said first input voltage, and input ends of said sixth pair are connected in common to be applied with a voltage at a middle point of a voltage applied between said input ends of said fifth pair; and said common-connected output ends of said first pair, said common-connected output ends of said third pair and said common-connected output ends of said sixth pair are connected in common to form one of differential output ends, and said common-connected connected output ends of said second pair, said common-connected output ends of said fourth pair and said common-connector output end of said fifth pair are connected in common to form the other of said differential output ends.

14. The multiplier as claimed in claim 13, wherein said first to twelfth transistors are bipolar transistors;

bases of said third transistor and said fourth transistor are connected in common to be connected through a first resistor to a base of said first transistor on the one hand, and to be connected through a second resistor whose resistance value is equal to that of said first resistor to a base of said second transistor, on the other hand;

bases of said seventh transistor and said eighth transistor are connected in common to be connected through a third resistor to a base of said fifth transistor on the one hand, and to be connected through a fourth resistor whose resistance value is equal to that of said third resistor to a base of said sixth transistor, on the other hand; and bases of said eleventh transistor and said twelfth transistor are connected in common to be connected through a fifth resistor to a base of said ninth transistor on the one hand, and to be connected through a sixth resistor whose resistance value is equal to that of said fifth resistor to a base of said tenth transistor, on the other hand.

15. The multiplier as claimed in claim 14, wherein each of said first to fourth transistors of said first quadritail circuit has at least one diode at a corresponding emitter of each of said first to fourth transistors, and emitters of said first to fourth transistors are connected through said diode to said first constant current source, respectively;

each of said fifth to eighth transistors of said second quadritail circuit has at least one diode at a corresponding emitter of each of said fifth to eighth transistors, and emitters of said fifth to eighth transistor are connected through said diode to said second constant current source, respectively; and each of said ninth to twelfth transistors of said third quadritail circuit has at least one diode at a corresponding emitter of each of said ninth to twelfth transistors, and emitters of said ninth to twelfth transistors are connected thorough said diode to said third constant current source, respectively.

16. The multiplier as claimed in claim 14, wherein each of said first to fourth transistors of said first quadritail circuit has a resistor at a corresponding emitter of each of said first to fourth transistors, and emitters of said first to fourth transistors are connected through said resistor to said first constant current source, respectively;

each of said fifth to eighth transistors of said second quadritail circuit has a resistor at a corresponding emitter of each of said fifth to eighth transistors, and emitters of said fifth to eighth transistors are connected through said resistors to said second constant current source, respectively; and each of said ninth to twelfth transistors of said third quadritail circuit has a resistor at a corresponding emitter of each of said ninth to twelfth transistors, and emitters of said ninth to twelfth transistor are connected through said resistors to said third constant current source, respectively.

17. The multiplier as claimed in claim 13, wherein said first to twelfth transistors are MOS transistors;

gates of said third transistor and said fourth transistor are respectively applied with said first input voltage and said second input voltage, with common-connected gates of said first transistor and said second transistor as a reference;

said common-connected gates of said first transistor and said second transistor are applied with a voltage at a middle point of said voltage applied between said gates of said third transistor and said fourth transistor;

a gate of said seventh transistor is applied with said first input voltage with the same phase as that of said third transistor, and a gate of said eighth transistor is applied with a difference of said first input voltage and said second input voltage with opposite phase to that of said third transistor, with common-connected gates of said fifth transistor and said sixth transistor as a reference;

said common-connected gates of said fifth transistor and said sixth transistor are applied with a voltage at a middle point of said voltage applied between said gates of said fifth transistor and said sixth transistor;

a gate of said eleventh transistor is applied with said first input voltage with the same phase as that of said third transistor, and a gate of said twelfth transistor is applied with said second input voltage with opposite phase to that of said third transistor, with common-connected gates of said ninth transistor and said tenth transistor as a reference; and said common-connected gates of said ninth transistor and said tenth transistor are applied with a voltage at a middle point of said voltage applied between said gates of said eleventh transistor and said twelfth transistor.

18. The multiplier as claimed in claim 17, wherein gates of said first transistor and said second transistor are connected in common to be connected through a first resistor to a gate of said third transistor on the one hand, and to be connected through a second resistor whose resistance value is equal to that of said first resistor to a gate of said fourth transistor, on the other hand;

gates of said fifth transistor and said sixth transistor are connected in common to be connected through a third resistor to a gate of said seventh transistor on the one hand, and to be connected through a fourth resistor whose resistance value is equal to that of said third resistor to a gate of said eighth transistor, on the other hand; and gates of said ninth transistor and said tenth transistor are connected in common to be connected through a fifth resistor to a gate of said eleventh transistor on the one hand, and to be connected through a sixth resistor whose resistance value is equal to that of said fifth resistor to a gate of said twelfth transistor, on the other hand.

* * * * *

UNITED STATES PATENT AND TRADEMARK OFFICE

CERTIFICATE OF CORRECTION

PATENT NO. : 5,444,648

DATED : August 22, 1995

INVENTOR(S) : Katsuji KIMURA

It is certified that error appears in the above-indentified patent and that said Letters Patent is hereby corrected as shown below:

Col. 4, line 46, delete "$I_{d7}a_2$" and insert --$I_{d7}=a_2$--.

Col. 4, line 48, delete "$-V_{1H})^2$" and insert ---$V_{TH})^2$--.

Col. 5, line 24, delete $(I_{d5} + I_{d6})$ + $(I_{d7} + I_{d8})$" and insert -- $(I_{d5} - I_{d6})$ + $(I_{d7} - I_{d8})$--.

Col. 5, line 27, after "=" insert -- - --.

Col. 5, line 45, after "=" insert -- - --.

Col. 5, line 50, delete "$I_z$" and insert --$I_1$--.

Col. 10, line 27, delete "$I_E$" and insert --$I_R$--.

Col. 10, line 28, (both occurrences) delete "$I_E$" and insert --$I_R$--.

Col. 10, line 43, delete "$I_E$" and insert --$I_R$--.

Col. 10, line 44, delete "$I_E$" and insert --$I_R$--.

Col. 11, line 61, delete "Q1" and insert --Q11--.

Col. 12, line 45, delete "$I_E$" and insert --$I_R$--.

Col. 12, line 46, delete "$I_E$" and insert --$I_R$--.

UNITED STATES PATENT AND TRADEMARK OFFICE

CERTIFICATE OF CORRECTION

PATENT NO. : 5,444,648

DATED : August 22, 1995

INVENTOR(S) : Katsuji Kimura

It is certified that error appears in the above-indentified patent and that said Letters Patent is hereby corrected as shown below:

Col. 12, line 64, delete "$I_E$" and insert --$I_R$--.

Col. 12, line 66, delete "$I_E$" and insert --$I_R$--.

Col. 13, line 2, delete "$I_E$" and insert --$I_R$--.

Col. 13, line 7, delete "$I_E$" and insert --$I_R$--.

Col. 16, line 51, delete ",".

Col. 17, line 59, delete "Q2" and insert --Q12'--.

Col. 20, line 2, delete "$R_1$" and insert --$R_E$--.

Col. 20, line 5, delete "$E_E$" and insert --$R_E$--.

Col. 20, line 11, delete "$V_r$" and insert --$V_T$--.

UNITED STATES PATENT AND TRADEMARK OFFICE

CERTIFICATE OF CORRECTION

PATENT NO. : 5,444,648
DATED : August 22, 1995
INVENTOR(S) : Katsuji KIMURA

It is certified that error appears in the above-indentified patent and that said Letters Patent is hereby corrected as shown below:

Col. 21, line 42, delete "eights" and insert --eighth--.

Col. 23, line 12, delete "aid" and insert --said--.

Signed and Sealed this

Second Day of July, 1996

Bruce Lehman

*Attest:*

BRUCE LEHMAN

*Attesting Officer*

*Commissioner of Patents and Trademarks*